US006342754B1

(12) United States Patent
Kuroda et al.

(10) Patent No.: US 6,342,754 B1
(45) **Date of Patent: *Jan. 29, 2002**

(54) CHARGE-REDUCING FILM, IMAGE FORMING APPARATUS INCLUDING SAID FILM AND METHOD OF MANUFACTURING SAID IMAGE FORMING APPARATUS

(75) Inventors: Kazuo Kuroda, Atsugi; Hiroshi Takagi; Yoichi Osato, both of Yokohama; Noriaki Ohguri, Zama; Yoshimasa Okamura, Odawara; Takao Kusaka, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/999,129

(22) Filed: Dec. 29, 1997

(30) Foreign Application Priority Data

| | | |
|---|---|---|
| Dec. 27, 1996 | (JP) | 8-350127 |
| Dec. 27, 1996 | (JP) | 8-350128 |
| Apr. 7, 1997 | (JP) | 9-088514 |
| Apr. 7, 1997 | (JP) | 9-088515 |
| Dec. 26, 1997 | (JP) | 9-360957 |

(51) Int. Cl.[7] ..... H01J 1/62

(52) U.S. Cl. ..... 313/292; 313/495; 313/422; 313/309; 445/24

(58) Field of Search ..... 313/292, 495, 313/258, 309, 336, 487, 480, 496, 422; 445/24, 25; 257/691, 629; 427/96, 97, 100, 101, 124, 126.2; 252/62 BR, 62.3 BT, 62.3 C

(56) References Cited

U.S. PATENT DOCUMENTS

| | | | | |
|---|---|---|---|---|
| 3,622,901 A | | 11/1971 | Ledran et al. | 338/25 |
| 4,016,061 A | | 4/1977 | Wasa et al. | 204/192 F |
| 4,510,178 A | * | 4/1985 | Paulson et al. | 427/94 |
| 5,548,181 A | * | 8/1996 | Jones | 313/309 |
| 5,614,781 A | * | 3/1997 | Spindt et al. | 313/422 |

FOREIGN PATENT DOCUMENTS

| | | |
|---|---|---|
| EP | 0201609 | 11/1986 |
| EP | 0536607 | 4/1993 |
| EP | 0721195 | 7/1996 |
| GB | 1429610 | 3/1976 |
| JP | 57-118355 | 7/1982 |
| JP | 61-124031 | 6/1986 |
| JP | 407297265 A | 11/1995 |
| WO | WO 94/18694 | 8/1994 |
| WO | WO 96-2933 A1 | 2/1996 |

OTHER PUBLICATIONS

Hartwell, et al., "Strong Electron Emission . . . Thin Films", Int'l Electron Devices Meeting, Washington, D.C., pp. 519–521 (1975).

Araki, et al., "Electroforming and . . . Thin Films", J. Vacuum Soc., Japan, vol. 26, No. 1, pp. 22–29 (1983).

Dittmer, G. "Electrical Conduction . . . Thin Films", Thin solid Films, vol. 9, pp. 317–328 (1972).

(List continued on next page.)

*Primary Examiner*—Michael H. Day
*Assistant Examiner*—Joseph Williams
(74) *Attorney, Agent, or Firm*—Fitzpatrick, Cella, Harper & Scinto

(57) ABSTRACT

A charge-reducing film is used for coating a surface within a vacuum container containing electron-emitting devices to prevent deviations of electron beams caused by electric charges of the furface. The charge-reducing film comprises a nitrogen compound containing one or more than one transition metals and at least one element selected from aluminum, silicon and boron. An oxide layer may be arranged on the charge-reducing layer.

60 Claims, 16 Drawing Sheets

OTHER PUBLICATIONS

Elinson, et al., "The Emission of Hot Electrons . . . In Oxide", IEEE, Radio Eng. & Electronic Phys. 10 (9165), pp. 1290–1296 no date aval.
C. A. Mead, "Operation of Tunnel–Emission Devices", J. Appl. Phys., vol. 32, (1961), 646–652.
Spindt, et al., "Physical properties of thin film . . . cones", J. Appl. Phys., vol. 47, No. 12, Dec. 1976, 5248–5263.
Dyke, et al., "Field Emission", Adv. in Electronics and Electron Physics, vol. VIII, published by Academic Press Inc. (1956), 89–185.

* cited by examiner

CHARGE-REDUCING FILM, IMAGE FORMING APPARATUS INCLUDING SAID FILM AND METHOD OF MANUFACTURING SAID IMAGE FORMING APPARATUS

BACKGROUND OF THE INVENTION

1. Filed of the Invention

This invention relates to a charge-reducing film to be used in a container containing electron-emitting devices and to an image-forming apparatus comprising electron-emitting devices, an image-forming member and spacers. It also relates to a method of manufacturing such an image-forming apparatus.

2. Related Background Art

Flat panel displays are attracting attention as they save space and are lightweight and hence expected to eventually replace CRT displays. Currently available flat panel displays include the liquid crystal display type, the plasma emission type and the type that utilizes multiple electron sources. Plasma emission type and multiple electron source type displays provide a large visual angle and can display high quality images comparable to those displayed by CRT displays.

FIG. 15 of the accompanying drawings shows a schematic cross sectional view of a display apparatus comprising a large number of minute electron sources. It specifically comprises electron sources 51 formed on a glass rear plate 52, a glass face plate 54 on which fluorescent members 55 are arranged and a support frame 53 airtightly bonded to the outer peripheries of the rear and face plates for supporting them and providing an envelope for the display that secures a vacuum condition in the inside. The electron sources typically comprise so many cold cathode type electron-emitting devices such as field emission type electron-emitting devices having a conical or needle-like tip adapted to field emission of electrons or surface-conduction electron-emitting devices because these devices can be arranged highly densely within a limited surface area. When the display has a large display screen, however, the rear plate and the face plate have to be made very thick in order to make them withstand the pressure difference between the external atmospheric pressure and the internal vacuum of the envelope. Such a display is very heavy and, at the same time, can show distorted images if viewed aslant relative to the display screen. Therefore, there have been proposed various support structures that are referred to as spacers or ribs and designed to be arranged between the rear plate and the face plate in order to make the glass plates of the display withstand the pressure difference between the outside and the inside of the envelope if they are relatively thin. The rear plate on which electron sources are arranged and the face plate carrying thereon fluorescent members are typically separated by a distance between less than a millimeter and several millimeters and the inside of the envelope is held to an elevated degree of vacuum.

Then, a voltage as high as hundreds of volts is applied between the electron sources and the fluorescent members by way of an anode (metal back) (not shown) in order to accelerate the electrons emitted from the electron sources. In other words, an electric field stronger than 1 kV/mm is applied between the fluorescent members and the electron sources so that, if spacers are used, they can give rise to electric discharges on their part. Additionally, the spacers can become electrically charged as electrons emitted from the electron sources located close to them hit them and cations ionized by emitted electrons adhere them, if partly.

Then, electrically charged spacers divert the courses of nearby electrons emitted from the electron sources to make them miss the respective targets of fluorescent members so that the viewer will see a distorted image on the display screen behind the front glass plate.

There have been proposed techniques for eliminating electric charges of spacers by causing a weak electric current to flow through them (Japanese Patent Application Laid-Open Nos. 57-118355 and 61-124031). According to such a known technique, a high resistance thin film is formed on the surface of each insulating spacer so that a weak electric current may flow through the surface. Such a charge-reducing thin film is typically made of tin oxide, a crystalline mixture of tin oxide and indium oxide or metal.

A tin oxide thin film is highly sensitive to gaseous substances such as oxygen and hence often used in gas sensors. In other words, it can change its electric resistance if exposed to the atmosphere. Additionally, a thin film made of any of the above listed materials shows a low specific resistance and, therefore, a charge-reducing film layer may have to be formed with islands or it may have to be made extremely thin in order to make it electrically highly resistive.

In short, known techniques of forming an electrically highly resistive film are accompanied by drawbacks, including poor reproducibility and fluctuations in the resistance of the thin film that occur, particularly in some of the steps for manufacturing a display that involve the use of heat, such as the step of sealing the envelope by means of frit glass and that of baking the display (or heating the display while evacuating the inside of the envelope of the display).

SUMMARY OF THE INVENTION

In view of the above identified problems, it is therefore a principal object of the present invention to provide a charge-reducing film adapted to reduce the electric charge of a container containing electron-emitting devices. Another object of the present invention is to provide a thermally stable charge-reducing film.

Still another object of the present invention is to provide a charge-reducing film that can minimize the adverse effects of electric charge on emitted electrons.

A further object of the present invention is to provide an image-forming apparatus comprising spacers adapted to reduce the electric charge thereof.

A further object of the present invention is to provide an image-forming apparatus comprising thermally stable spacers.

A still further object of the present invention is to provide an image-forming apparatus comprising an image-forming member and spacers and adapted to minimize the adverse effects of electric charge on emitted electrons and also diversions of the courses of electrons emitted toward the image-forming member.

According to an aspect of the invention, there is provided a charge-reducing film characterized by comprising a nitrogen compound containing a transition metal and aluminum, silicon or boron.

According to another aspect of the invention, there is provided a charge-reducing film characterized by comprising a nitrogen compound containing a transition metal and aluminum, silicon or boron and the nitride ratio of said aluminum, silicon or boron is not less than 60%.

According to another aspect of the invention, there is provided a charge-reducing film characterized by comprising a film of a nitrogen compound containing a transition metal and aluminum, silicon or boron and an oxide layer arranged on the surface thereon.

According to still another aspect of the invention, there is provided a charge-reducing film characterized by comprising a film of a nitrogen compound containing a transition metal and aluminum, silicon or boron, the nitride ratio of said aluminum, silicon or boron being not less than 60%, and an oxide layer arranged on the surface thereof.

According to a further aspect of the invention, there is provided an image-forming apparatus comprising electron-emitting devices, an image-forming member and spacers arranged in an envelope, characterized in that each of said spacers comprises a substrate and any of the above defined charge-reducing films formed thereon.

According to a still further aspect of the invention, there is provided a method of manufacturing an image-forming apparatus comprising electron-emitting devices, an image-forming member and spacers, characterized by comprising steps of preparing spacers by coating substrates with any of the above defined charge-reducing films and arranging the spacers, electron-emitting devices and an image-forming member in an envelope and thereafter hermetically sealing the envelope, keeping, if necessary, a non-oxidizing atmosphere within the envelope.

DESCRIPTION OF THE PREFERRED EMBODIMENTS

Figure 1:
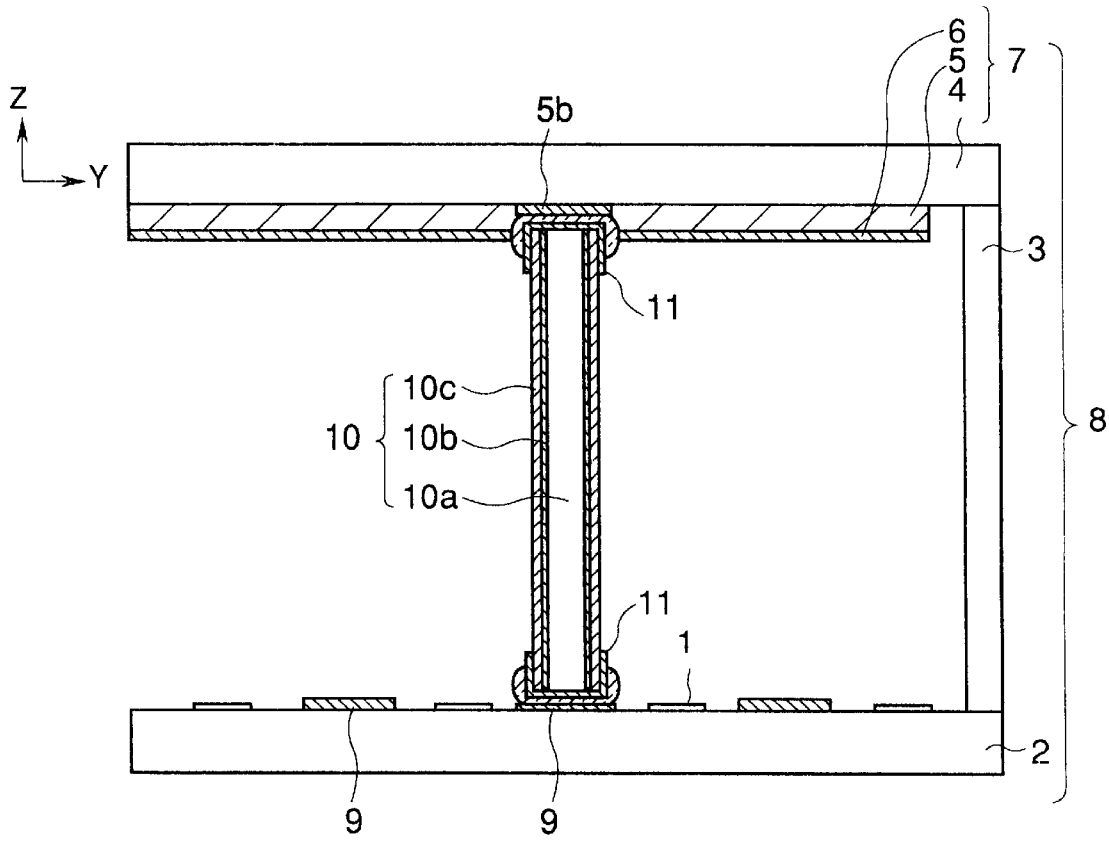
FIG. 1 is a schematic partial cross sectional view of an embodiment of image-forming apparatus according to the invention, showing a spacer and its vicinity.

While a charge-reducing film according to the invention will be described hereinafter in terms of applications where it is used on spacers used in an image-forming apparatus comprising electron-emitting devices, such a film can also be used on the surface of certain objects arranged in the container of an apparatus and/or the inner surface of the container that contains therein electron-emitting devices. For example an image-forming apparatus in order to reduce the charge-induced adverse effect of emitted electrons and also fluctuations in the performance of the charge-reducing film itself due to the steps of manufacturing such an apparatus that involve the use of heat as described earlier.

A charge-reducing film is an electroconductive film and, when used to coat an insulating substrate, it can remove the electric charge accumulated on the surface of the insulating substrate. Generally, it is preferable that the surface resistance (sheet resistance Rs) of a charge-reducing film does not exceed $10^{12}$ Ω. More preferably, the surface resistance of a charge-reducing film is less than $10^{11}$ Ω to provide a satisfactory charge-reducing effect. In other words, the lower the resistance, the greater the charge-reducing effect.

When a charge-reducing film is used on the spacers of a display apparatus, a desired allowable range is assigned to the surface resistance Rs of the spacers from the point of view of charge-reduction and power saving. More specifically, the lower limit of the sheet resistance is defined from the point of view of power saving. The lower the resistance, the quicker the electric charge accumulated on the spacer will be eliminated but the greater the power consumption rate of the spacer will be. A semiconductor film is preferably used for spacers relative to a metal film having a low specific resistance because, when a metal film with a low specific resistance is used for a charge-reducing film, it will have to be made very thin in order to achieve a desired surface resistance Rs. Generally speaking, a thin film having a thickness less than 10 nm produces islands therein to make. This makes resistance of the film unstable and the film reproduces poorly depending on the surface energy of the thin film, the contact between the thin film and the substrate and the temperature of the substrate.

Therefore, a preferable choice will be a semiconductor material having a specific resistance higher than any electroconductive metal but lower than any insulating material. More often than not, however, such a material has a negative temperature coefficient of resistance. A charge-reducing film made of a material having a negative temperature coefficient of resistance gradually loses its resistance to allow a large electric current to flow therethrough if it is arranged on a spacer as its temperature rises due to the power consumed on the spacer surface until a thermal runaway occurs as a result of the generation of a large volume of heat and a wild temperature hike that takes place there. However, such a thermal runaway can hardly occur if the heat generation or the power consumption and the heat discharge are well balanced. Additionally, a thermal runaway can not occur easily if the absolute value of the temperature coefficient of resistance (TCR) of the material of the charge-reducing film is small.

It has been found as a result of a series of experiments that the electric current flowing through a spacer continuously increases to give rise to a thermal runaway when the power consumption rate per square centimeter exceeds about 0.1 W if the spacer is coated with a charge-reducing film having a TCR of −1%. While the occurrence of such a thermal runaway depends on the profile of the spacer, the voltage Va applied to the spacer and the temperature coefficient of resistance of the charge-reducing film, the value of Rs with which the power consumption rate per square centimeter does not exceed 0.1 W will not be less than $10\times Va^2/h^2\Omega$ in view of the above requirements, where h(cm) is the distance between the members separated by spacers, which are the face plate and the rear plate in the case of a display apparatus.

Thus, the sheet resistance Rs of a charge-reducing film arranged on a spacer is preferably between $10\times Va^2\Omega$ and $10^{11}$ Ω in view of the fact that h is typically not greater than 1 cm in the case of an image-forming apparatus that may be a flat panel display.

The charge-reducing film formed on an insulating substrate as described above preferably has a thickness of not less than 10 nm. If the film has a thickness exceeding 1 μm, the film shows a large stress and can come off from the substrate with ease. Additionally, such a thick film provides a poor productivity because it requires a long film forming time. The film thickness is preferably between 10 nm and 1 μm, more preferably between 20 and 500 nm.

The specific resistance ρ of a charge-reducing film which is the product of the sheet resistance Rs and the film thickness t is preferably between $10^{-7}\times Va^2\Omega m$ and $10^5$ Ωm in view of the above cited values for Rs and t for the purpose of the invention. More preferably, ρ is between $(2\times10^{-7})\times Va^2\Omega m$ and $5\times10^4$ Ωm to realize the above cited preferable values for the sheet resistance and the film thickness.

The acceleration voltage Va for accelerating electrons in a display apparatus according to the invention is not lower than 100V. A high voltage of 1 kV or more will be needed to ensure a sufficient level of brightness when a flat panel display according to the invention comprises fluorescent members that are adapted to high speed electrons and similar to those commonly used in CRTs.

Under the condition of Va=1 kV, the preferable range of the specific resistance of a charge-reducing film is between 0.1 ΩQm and $10^5$ Ωm.

As a result of intensive research efforts in finding materials that can suitably be used for a charge-reducing film according to the invention, the inventors of the present invention discovered that a charge-reducing film performs excellently if it is made of a nitrogen compound containing a transition metal and aluminum, a nitrogen compound containing a transition metal and silicon or a nitrogen compound of a transition metal and boron. The transition metal to be used for the purpose of the invention is selected from Ti, V, Cr, Mn, Fe, Co, Ni, Cu, Zr, Nb, Mo, Hf, Ta and W. Alternatively, two or more than two of transition metals can be used in combination. A transition metal or nitride thereof is an excellent conductor of electricity, whereas aluminum nitride (AlN), silicon nitride ($Si_3N_4$) and boron nitride (BN) are insulators. Thus, the specific resistance of a charge-reducing film made of any of the above listed nitrogen compounds for the purpose of the invention can be adapted to an appropriate value between the specific resistance of a conductor and that of an insulator by controlling the content of the transition metal. In other words, a desired value can be realized for the specific resistance of a charge-reducing film for spacers by selecting an appropriate value for the transition metal content of the film.

Figure 13:
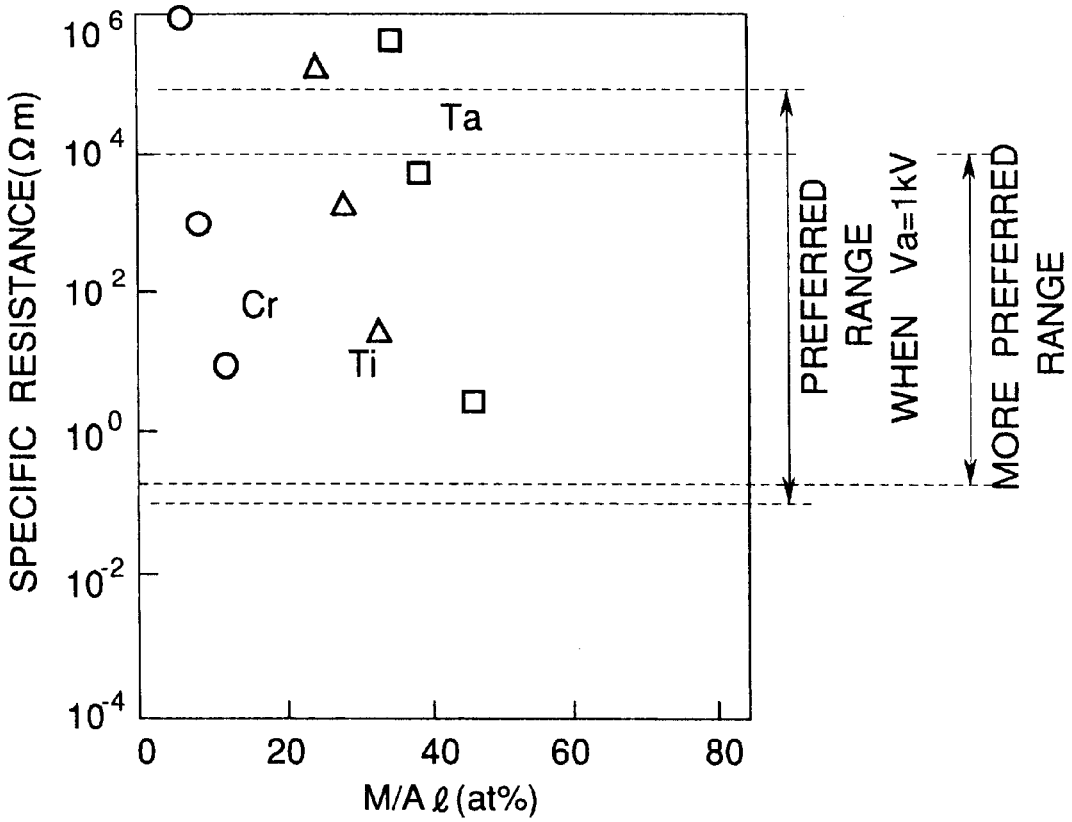
FIG. 13 is a graph showing the composition (M:transition metal/Al) dependency of the specific resistance of an aluminum-transition metal nitride film that can be used for the purpose of the invention.

A nitrogen compound containing aluminum and Cr, Ti or Ta changes its specific resistance as a function of its metal content ratio (transition metal M/aluminum Al) as shown in FIG. 13. The ratio of the transition metal content relative to the aluminum content that can produce a desired specific resistance will be between 5 and 18 at % if the transition metal is Cr, between 24 and 40 at % if the transition metal is Ti and between 36 and 50 at % if the transition metal is Ta. The ratio will be between 3 and 18 at % if the transition metal is Mo (Mo/Al) and between 3 and 20 at % if the transition metal is W (W/Al).

On the other hand, in the case of a nitrogen compound containing silicon and a transition metal, the ratio of the transition metal content relative to the silicon content will be between 7 and 40 at % if the transition metal is Cr, between 36 and 80 at % if the transition metal is Ta and between 28 and 67 at % if the transition metal is Ti. In the case of a nitrogen compound containing boron and a transition metal, the ratio of the transition metal content relative to the boron content will be between 20 and 60 at % if the transition metal is Cr, between 40 and 120 at % if the transition metal is Ta and between 30 and 80 at % if the transition metal is Ti.

It has also been found that a charge-reducing film made of a nitrogen compound containing a transition metal and aluminum, silicon or boron is a good choice for manufacturing an image-forming apparatus because it changes its electric resistance only very little and operates stably as will be described hereinafter. Such a substance is least prone to thermal runaway because the absolute value of its temperature coefficient of resistance is not greater than 1% although the coefficient shows a negative value. Additionally, such a nitrogen compound shows a low rate for secondary electron emission and hence is not liable to become electrically charged if irradiated with electrons so that it can suitably be used for a display apparatus utilizing electron beams.

A nitrogen compound containing a transition metal and aluminum, silicon or boron that is to be used for a charge-reducing film for the purpose of the invention can be formed on an insulating substrate by means of an appropriate thin-film forming technique selected from sputtering, reactive sputtering, electron beam evaporation, ion plating, ion-assisted evaporation and CVD. If sputtering is used, a target of aluminum, silicon or boron and a transition metal is sputtered in a gaseous atmosphere containing either nitrogen or ammonium to nitride the sputtered metal atoms, thereby producing a nitrogen compound containing the transition metal and aluminum, silicon or boron. An alloy of the transition metal and aluminum, silicon or boron whose contents have been regulated may alternatively be used for the target. While the nitrogen content of the nitrogen compound film may vary depending on the conditions of sputtering including the gas pressure, the nitrogen partial pressure and the film forming rate, a film containing nitrogen to an enhanced degree operates stably for the purpose of the invention.

While the electric resistance of a nitride may vary depending on the nitrogen concentration of the nitride film and the defects in the film, the electroconductivity attributable to such defects will decrease as they are eliminated in the course of manufacturing steps involving the use of heat. Therefore, a film that has been sufficiently nitrided and is not accompanied by many defects will operate stably for the purpose of the invention. A charge-reducing film to be used for spacers according to the invention is stable because it is made of nitride of aluminum, silicon or boron and its electrocoductivity is provided by the transition metal element it contains. Preferably, more than 60 at % of the aluminum, silicon or boron atoms contained in a nitrogen compound to be used for the purpose of the invention is in the form of nitride. More specifically, more than 65% of the silicon atoms are preferably in the form of silicon nitride if silicon is used, whereas more than 70% of the aluminum or boron atoms are preferably in the form of aluminum or boron nitride if aluminum or boron is used.

For the purpose of the invention, an image-forming apparatus is preferably manufactured in an atmosphere where the nitrogen compound film on the surface of the spacers is not oxidized, although the film can be exposed to a hot and oxidizing atmosphere in the course of manufacturing the apparatus as in the hermetically sealing step. It should be noted that a nitride containing nitrogen by less than the stoichiometric ratio is apt to be oxidized and that, while a nitrogen compound film to be used for the purpose of the invention is polycrystalline, a film having a better crystal orientation is less apt to be oxidized. S. E. E. yield of a spacer that affects the electric charge of the spacer is mainly controlled by the material covering the surface of the spacer by tens of several nanometers. Thus, a spacer whose surface has been oxidized in the course of manufacturing the image-display apparatus that comprises it shows a poor charge-reducing effect because the rate of secondary electron emission of the spacer is raised as the result of oxidation. Therefore, a nitride that is less apt to form an oxide layer and hence shows a satisfactory degree of nitridation or an excellent degree of crystal orientation is preferably used for spacers for the purpose of the invention.

The nitrogen content (degree of nitridation) of a nitride can be raised under certain conditions selected to irradiate the surface of a thin film with highly energized nitrogen ions, typically by applying a negative bias voltage to the substrate. The crystal orientation is likely to be improved under such conditions so that a thin film with an enhanced nitrogen content will show an improved charge-reducing effect. For the purpose of the present invention, the degree of nitridation is expressed in terms of the ratio of the concentration of aluminum, silicon or boron atoms to that of nitrided atoms of the element, which ratio is determined by means of an XPS (X-ray photoelectric spectrometer). The XPS analysis of the nitride film after removing its surface layer by Ar ion sputtering has shown that the transition metal exists as a metal or a nitride in aluminum nitride, silicon nitride or boron nitride.

A charge-reducing film according to the invention operates satisfactorily if the surface of the nitride film is oxidized provided that the oxidized surface layer emits secondary electrons only at a low rate or the film surface is covered by a material showing a low rate of secondary electron emission.

Figure 3:
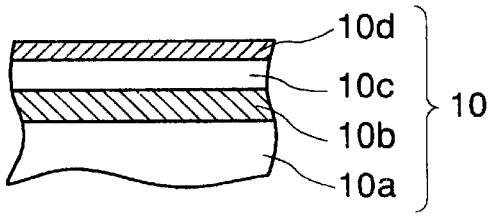
FIG. 3 is a schematic cross sectional view of a spacer according to the invention.

The inventors of the present invention initially looked into the possibility of using the oxide of a low secondary electron emitting material such as chromium oxide and found that a charge-reducing film comprising a layer of a nitrogen compound containing a transition metal and aluminum, silicon or boron as underlying layer and a layer of such an oxide arranged thereon operates excellently for electric charge reduction. Thus, in a preferred mode, a charge-reducing film according to the invention comprises an insulating substrate 10*a*, a nitrogen compound layer 10*c* containing a transition metal and aluminum, silicon or boron and an oxide film 10*d* as shown in FIG. 3.

In other words, the inventors of the present invention succeeded in producing a charge-reducing film to be used for spacers comprising a layer of a nitrogen compound containing a transition metal and aluminum, silicon or boron as underlying layer and a layer of an oxide arranged thereon. Such a charge-reducing film can be controlled with ease for specific resistance and does not change its electric resistance in the course of manufacturing steps involving the use of heat such as the step of sealing the envelope by means of frit glass conducted in an oxidizing atmosphere.

If a charge-reducing film according to the invention is made only of a nitrogen compound as described above and the envelope is hermetically sealed by means of frit glass, the film is preferably heated in an oxidizing atmosphere in the sealing step and then to higher temperature in a non-oxidizing atmosphere. This sealing operation in a non-oxidizing atmosphere is necessary to prevent (or reduce) oxidation of the surface of the nitrogen compound layer. On the other hand, while the sealing step using the frit has to be conducted in an oxidizing atmosphere to drive off the binder, this sealing step can be carried out conveniently in a simple manner when an oxide film layer is formed on a film of a nitrogen compound for spacers because the use of a non-oxidizing atmosphere is not necessary.

Oxides that can preferably be used for a charge-reducing film for the purpose of the invention include chromium oxide, copper oxide and nickel oxide as these oxides of transition metal show a low rate of secondary electron emission, although an oxygen compound film containing a transition metal and aluminum, silicon or boron may also effectively be used. Such an oxygen compound film can be obtained by oxidizing a nitrogen compound film as described above. While the oxidation of a nitrogen compound film is typically conducted in an oxidizing atmosphere, the nitrogen compound film may alternatively be heated in the atmosphere to produce an oxide film before manufacturing an image-forming apparatus by using spacers coated with such an oxide film. Still alternatively, the oxidation may be conducted while the image-forming apparatus is being manufactured. The thickness of the oxide layer depends on the heating temperature and the heating time. While the oxygen compound film may contain an alloy of the components to the same extent as the alloy content of the nitrogen compound film, the charge-reducing effect of the charge-reducing film will be greater if the content of the transition metal it contains increases near the surface thereof. This is because the oxide of a transition metal shows a specific resistance lower than that of aluminum oxide or shows a relatively low rate of secondary electron emission.

The overall resistance of the charge-reducing film layers (10*c* and 10*d*) is practically defined by the resistance of the nitrogen compound film. Since the resistance of an oxide film is highly dependent on the atmosphere in which it is located, the thickness of the oxide film has to be so determined that its resistance exceeds a half of the overall resistance of the charge-reducing film. In order for the courses of electrons emitted from the electron source not to be diverted nor disturbed, the potential distribution between the face plate and the rear plate has to be uniform or the spacers have to show a substantially evenly distributed resistance. If the potential distribution is disturbed, electrons expected to reach the fluorescent members located close to the spacers are diverted from their respective courses to produce distorted images. The spacers arranged in an image-forming apparatus according to the invention are made to show an even distribution of electric resistance by providing a stable nitride film so that the image-forming apparatus may display undistorted images.

For the purpose of the invention, an oxide film 10*d* may be formed through vacuum evaporation or sputtering of a transition metal in an oxidizing atmosphere in place of oxidizing a nitride film 10*c*. Alternatively, an alkoxide technique may be employed.

While a charge-reducing film is used for the spacers of a display apparatus in the above description, such a film can also be used on the surface of certain objects arranged in the container of an apparatus and/or the inner surface of the container that contains therein electron-emitting devices as in the case of an image-forming apparatus, because materials made of a nitrogen compound as described above have a high melting point and are very hard.

Two known types of electron-emitting devices can be used for the purpose of the invention; the thermionic electron type and the cold cathode type. Cold cathode type electron-emitting devices refer to the field emission type (hereinafter referred to as the FE type), the surface conduction electron-emitting type and the metal/insulation layer/metal type (hereinafter referred to as the MIM type). While electron-emitting devices of any of these types may be used for the purpose of the invention, the cold cathode type is a preferable choice.

Examples of surface-conduction type electron-emitting device include the one proposed in M. I. Elinson, Radio Eng. Electron Phys., 10 (1965). A surface-conduction electron-emitting device is realized by utilizing the phenomenon that electrons are emitted out of a thin film with a small area formed on a substrate when an electric current is forced to flow in parallel with the film surface. While Elinson proposes the use of $SnO_2$ thin film for a device of this type, the use of Au thin film is proposed in G. Dittmer: "Thin Solid Films", 9, 317 (1972) whereas the use of $In_2O_3/SnO_2$ thin film and that of carbon thin film are discussed respectively in M. Hartwell and C. G. Fonstad: "IEEE Trans. ED Conf.", 519 (1975) and H. Araki et al.: "Vacuum", Vol. 26, No. 1, p. 22 (1983). The use of fine particle film for the electron-emitting region of an electron-emitting device is also known as will be described hereinafter by referring to preferred embodiments of the invention. Examples of FE type device include those proposed by W. P. Dyke & W. W. Dolan, "Field emission", Advance in Electron Physics, 8, 89 (1956) and C. A. Spindt, "PHYSICAL Properties of thin-film field emission cathodes with molybdenum cones", J. Appl. Phys., 47, 5248 (1976). Examples of MIM type device are disclosed in papers including C. A. Mead, "The tunnel-emission amplifier", J. Appl. Phys., 32, 646 (1961).

Now, a charge-reducing film and an image-forming apparatus comprising spacers coated with such a charge-reducing film according to the invention will be described in greater detail by referring to the accompanying drawings.

FIG. 1 is a schematic partial cross sectional view of an image-forming apparatus according to the invention, showing only a spacer and its vicinity. There are shown electron sources 1, a rear plate 2, a lateral wall 3 and a face plate 7, the airtight container (envelope 8) of the apparatus being constituted by the rear plate 2, the lateral walls 3 and the face plate 7 to maintain a vacuum condition in the inside of the display panel.

Figure 16A:
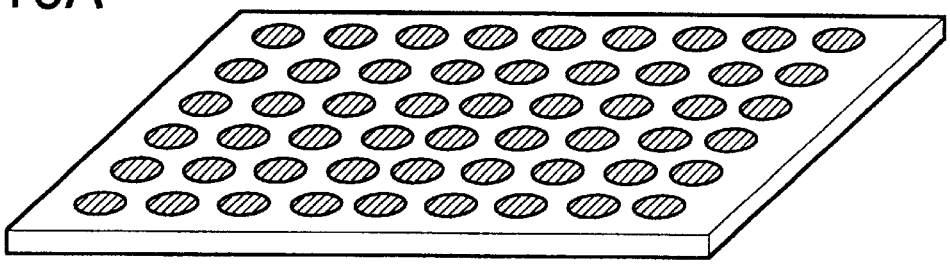
FIGS. 16A and 16B are schematic perspective views of two alternative types of spacer that can be used for the purpose of the invention.
Figure 16B:
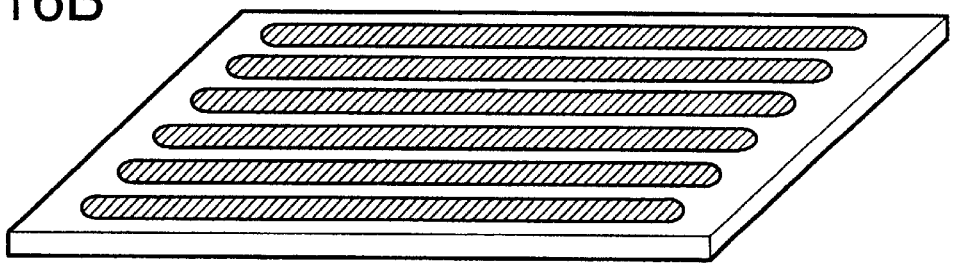

Reference numeral 10 denotes a spacer comprising an insulating substrate 10*a* and a charge-reducing film 10*c* formed on the surface of the insulating substrate. Spacers 10 are used to prevent the vacuum envelope 8 from being damaged or deformed by the atmospheric pressure as the inside of the envelope 8 is held in a vacuum condition. The material, the profile, the locations and the number of the spacers are determined as a function of the profile and the thermal expansion coefficient of the envelope 8 as well as the pressure and the heat to which the envelope is exposed. For the purpose of the invention, each spacer may be realized in the form of a flat panel, a cross or letter L. Alternatively, a spacer panel having through holes corresponding to a plurality of electron sources as shown in FIGS. 16A or 16B may suitably be used. The effect of spacers will become remarkable when they are used in a large image-forming apparatus.

The insulating substrate 10*a* is preferably be made of a material showing high mechanical strength and high thermal resistance such as glass or ceramic because the spacers have to bear the atmospheric pressure applied to the face plate 7 and the rear plate 2. If the face plate and the rear plate are made of glass, the insulating substrate 10*a* is preferably made also of glass or of a material having a thermal expansion coefficient close to that of glass.

If the insulating substrate 10*a* is made of glass containing alkali ions such as soda lime glass containing Na ions, the electroconductivity of the charge-reducing film can be modified by Na ions. However, the invasion of Na ions or some other alkali ions into the charge-reducing film 10*c* can be prevented by arranging a Na block layer 10*b* typically made of silicon nitride or aluminum oxide between the insulating substrate 10*a* and the charge-reducing film 10*c*.

Since the spacers 10 are electrically connected to the metal back 6 and the X-directional wires 9 (as will be described in detail hereinafter) for driving the electron sources 1 by way of electroconductive frit glass, the acceleration voltage Va of the apparatus is applied to the opposite ends of each of the spacers 10. While the spacers are connected to the wires in FIG. 1, they may alternatively be connected to a specifically arranged electrode. If an intermediary electrode panel (like a grid-electrode) is arranged between the face plate 7 and the rear plate 2 in order to keep electron beams in good shape and reduce the electric charge at the insulator of the substrate, the spacers may run through the intermediary electrode panel or spacers may be arranged on the opposite sides of the intermediary electrode panel.

The electric connection of the charge-reducing film with the electrodes on the face plate and the rear plate is improved if the spacers are provided at the opposite ends with electrodes 11 made of an electroconductive material such as Al or Au.

Figure 2:
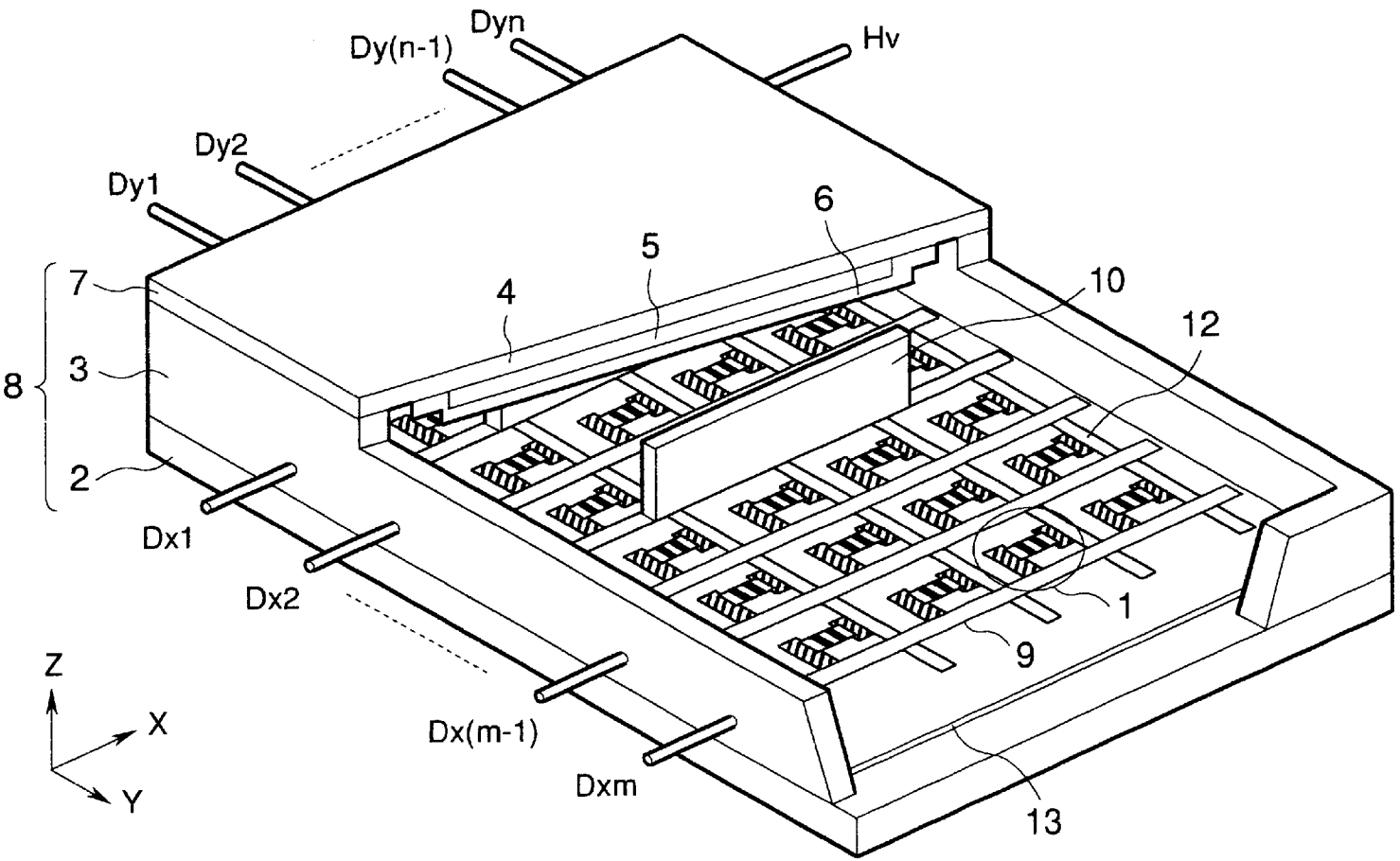
FIG. 2 is a schematic perspective view of an image-forming apparatus according to the invention, showing the inside by cutting away part of the display panel thereof.

Now, the basic configuration of an image-forming apparatus according to the invention and comprising spacers 10 will be described. FIG. 2 is a schematic perspective view of an image-forming apparatus according to the invention, showing the inside by cutting away part of the display panel thereof.

Referring to FIG. 2, an airtight container (envelope 8) is formed of a rear plate 2, side walls 3 and a face plate 7 to maintain the inside of the display panel under a vacuum condition. The components of the airtight container have to be securely bonded to each other in order to provide the envelope with a sufficient degree of strength and airtightness at the junctions of the components. Typically, the components are bonded to each other by applying frit glass to the junctions and baking the frit glass at 400 to 500° C. for more than 10 minutes in the ambient atmosphere or preferably, in a non-oxidizing atmosphere of nitrogen gas in order to prevent the nitrogen compound film formed on the surface of the spacers from being oxidized. The airtight container is then evacuated in a manner as will be described hereinafter.

A substrate 13 is rigidly secured to the rear plate 2 and a total of NxM cold cathode type electron-emitting devices are formed on the substrate 13 (N and M being integers not smaller than 2 selected depending on the number of display pixels used in the image-forming apparatus and preferably equal to or greater than 3,000 and 1,000 respectively when the apparatus is used for a high quality television set). The NxM cold cathode type electron-emitting devices are provided with a simple matrix wiring arrangement using M X-directional wires 9 and N Y-directional wires 12. The portion of the apparatus comprising the substrate 13, the cold cathode type electron-emitting devices 1, the X-directional wires 9 and the Y-directional wires 12 is referred to as a multi-electron-beam source. The manufacturing method and the configuration of the multi-electron-beam source will be described in detail hereinafter.

While the substrate 13 of the multi-electron-beam source is secured to the rear plate 2 of the airtight container in the above description, the substrate 13 of the multi-electron-beam source itself may be used as the rear plate of the airtight container if it provides a sufficient strength to the container.

Figure 4A:
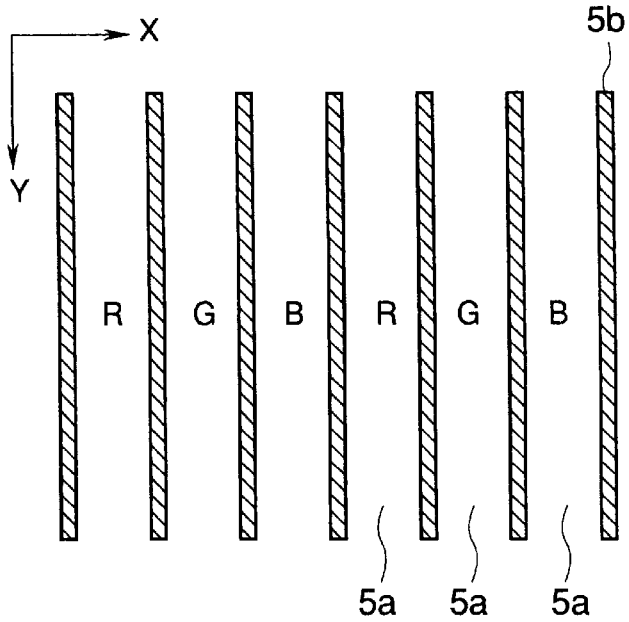
FIGS. 4A and 4B are plan views or two alternative arrangements of fluorescent members on the face plate of the display panel of an image-forming apparatus according to the invention.

A fluorescent film 5 is formed under the face plate 7. Since the mode of carrying out the invention as described here is for displaying color images, the fluorescent film 5 actually comprises fluorescent members of the primary colors of red (R), green (G) and blue (B). Referring to FIG. 4A, stripe-shaped fluorescent members of the primary colors Sa are arranged regularly with black conductive stripes 5*b* interposed therebetween. The black stripes 5*b* are provided in order to avoid color breakups on the displayed image if electron beams are deviated slightly from respective targets in the envelope, degradation of the contrast of the displayed image by preventing reflections of external light and charged up conditions of the fluorescent film due to electron beams. While graphite is normally used as principal ingredient of the black stripes 5*b*, other conductive material having low light transmissivity and reflectivity may alternatively be used.

Figure 4B:
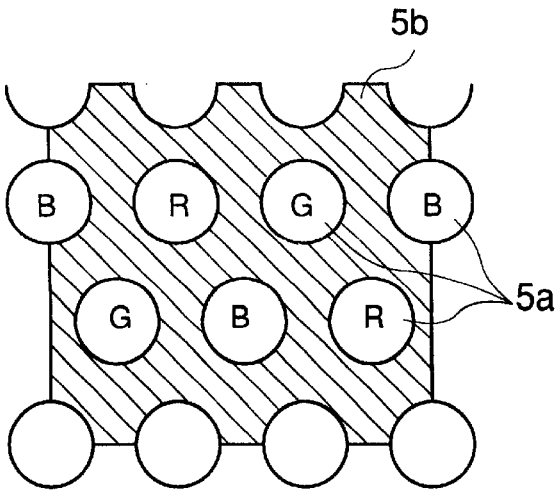

The stripe-shaped fluorescent members of the primary colors shown in FIG. 4A may be replaced by deltas of fluorescent members of the primary colors as shown in FIG. 4B or some other arrangement.

If the image-forming apparatus is designed for displaying monochromic images, the fluorescent film 5 is made of a monochromic fluorescent material as a matter of course. In this case, black conductions may not necessarily be used.

An ordinary metal back 6 is arranged on the inner surface of the fluorescent film 5, or the surface vis-a-vis the rear plate. The metal back 6 is provided in order to enhance the efficiency of the use of light of the apparatus by partly reflecting light emitted from the fluorescent film 5, protect the fluorescent film 5 against negative ions trying to collide with it, apply an acceleration voltage for electron beams and provide paths for conducting electrons that have been used for energizing the fluorescent film 5. It is prepared by smoothing the surface of the fluorescent film formed on the face plate substrate 4 and forming an Al film thereon by vacuum evaporation. The metal back 6 is omitted when a fluorescent material adapted to low voltages is used for the fluorescent film 5.

While not used in the above described mode of carrying out the invention, a transparent electrode typically made of ITO may be formed between the face plate substrate 4 and the fluorescent film 5 in order to apply a voltage to the acceleration electrode with ease and/or raise the conductivity of the fluorescent film 5.

In FIG. 2, Dx1 through Dxm, Dy1 through Dyn and Hv denote airtight electric connection terminals for electrically connecting the display panel and an external electric circuit (now shown). Of these, the terminals Dx1 through Dxm are electrically connected to the respective row-directional wires of the multi-electron-beam source, whereas the terminals Dy1 through Dyn are electrically connected to the respective column-directional wires. The terminal Hv is electrically connected to the metal back 6.

To produce a vacuum condition in the inside of the airtight container, the assembled airtight container is connected to an exhaust pipe and then to a vacuum pump and the inside of the airtight container is evacuated to a degree of vacuum of about $10^{-5}$ [Pa]. Thereafter, a piece of getter film (not shown) is formed at a predetermined position in the airtight container immediately before or after hermetically closing the exhaust pipe in order to maintain the above cited degree of vacuum within the airtight container. Getter film is formed by heating a getter material typically containing Ba as principal ingredient by means of a heater of high frequency and heating until it is evaporated and deposited to make a film thereof. Due to the adsorption effect of the getter film, the inside of the airtight container is maintained typically to a degree of vacuum between $10^{-3}$ [Pa] to $10^{-5}$ [Pa]. Hereinafter, the above process is referred to as "gettering process".

Now, the method of manufacturing the multi-electron-beam source of the display panel of an image-forming apparatus according to the invention will be described. Cold cathode devices to be used for the multi-electron-beam source of an image-forming apparatus according to the invention may be made of any material and have any profile if they are used with a simple matrix wiring arrangement in the multi-electron-beam source. In other words, the cold cathode electron-emitting devices may be surface conduction electron-emitting devices, FE type devices, MIM type devices or devices of some other type.

However, the use of surface-conduction electron-emitting devices may be the best choice to provide an image-forming apparatus having a large display screen at low cost. More specifically, as described earlier, FE type devices require highly precise manufacturing techniques because electron emitting performance of an FE type device is highly dependent on the relative positional relationship and the profiles of the conical emitter and the gate electrode, which is disadvantageous for producing a large display screen at reduced cost. In the case of using MIM type devices for a multi-electron-beam source, the insulation layers and the upper electrodes of the device have to be made very thin and uniform, which is also disadvantageous for producing a large display screen at low cost. On the other hand, surface conduction electron-emitting devices can be manufactured in a simple manner so that a large display screen can be produced with ease and at low cost. Additionally, to a great advantage of surface conduction electron-emitting devices, the inventors of the present invention discovered that devices comprising an electroconductive film including an electron-emitting region between a pair of device electrodes are particularly effective in emitting electrons and can be manufactured with ease. Such surface conduction electron-emitting devices are particularly suited for preparing a multi-electron-beam source for an image-forming apparatus having a large display screen that displays bright and clear images. A surface conduction electron-emitting device having the electron-emitting region and its vicinity made of fine particle film can be suitably used for the purpose of the invention. Now, a surface-conduction electron-emitting device will be described first in terms of basic configuration and manufacturing process. Then, a multi-electron-beam source comprising a large number of devices connected by simple matrix wiring will be described.

(Preferable Configuration and Manufacturing Method of a Surface Conduction Electron-Emitting Device)

Two major types of surface conduction electron-emitting device comprising an electroconductive film of fine particles including an electron-emitting region and arranged between a pair of electrodes are the plane type and the step type.

(Plane Type Surface Conduction Electron-Emitting Device)

Firstly, a plane type surface conduction electron-emitting device will be described in terms of configuration and manufacturing method.

Figure 5A:
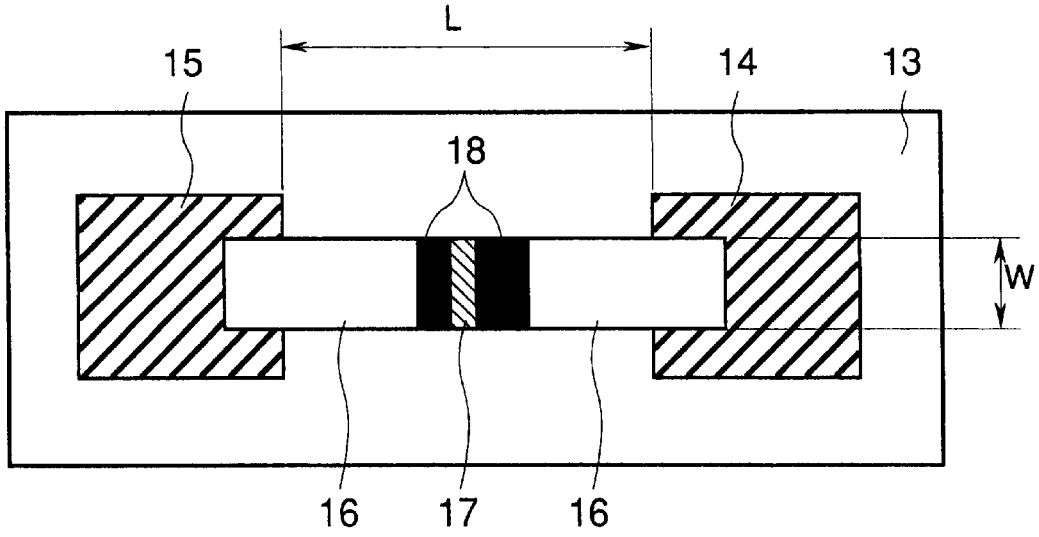
FIGS. 5A and 5B are a plan view and a cross sectional view of the substrate of a multiple electron beam source of an image-forming apparatus according to the invention.
Figure 5B:
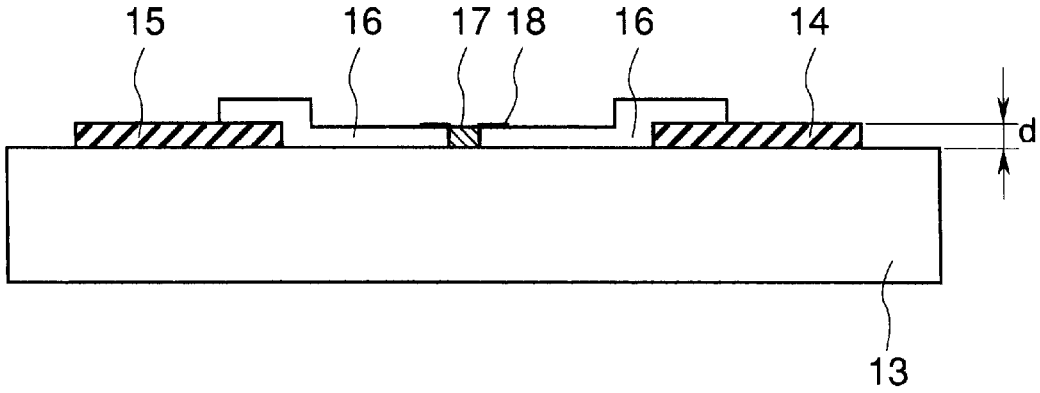

FIGS. 5A and 5B are schematic views showing a plane type surface conduction electron-emitting device that can be used for the purpose of the invention, of which FIG. 5A is a plan view and FIG. 5B is a sectional side view. Referring to FIGS. 5A and 5B, the device comprises a substrate 13, a pair of device electrodes 14 and 15, an electroconductive film 16, an electron-emitting region 17 formed by an energization forming process and a thin film 18 formed by an energization activation process.

The substrate 13 may be a glass substrate of quartz glass, soda lime glass or some other glass, a ceramic substrate of alumina or some other ceramic substance or a substrate obtained by layering an insulation layer of $SiO_2$ on any of the above listed substrates.

While the device electrodes 14 and 15 that are arranged oppositely and in parallel with the substrate may be made of any highly conducting material, preferred candidate materials include metals such as Ni, Cr, Au, Mo, W, Pt, Ti, Ag, Cu and Pd and their alloys, metal oxides such as $In_2O_3$-$SnO_2$ and semiconductor materials such as polysilicon. The electrodes can be formed without difficulty by way of a combined use of a film forming technique such as vacuum evaporation and a patterning technique such as photolithography or etching, although other techniques (e.g., printing) may alternatively be used.

The device electrodes 14 and 15 may have an appropriate profile depending on the application of the device. Generally, the distance L separating the device electrodes 14 and 15 is between tens of several nanometers and tens of several micrometers and preferably between several micrometers and tens of several micrometers if used for an image-forming apparatus. The film thickness d of the device electrodes 14 and 15 is between tens of several nanometers and several micrometers.

The electroconductive film 16 is preferably a film containing a large number of fine particles (including island-like agglomerates) in order to provide excellent electron-emitting characteristics. When observed microscopically, a fine particle film that can be used for the purpose of the invention contains a large number of fine particles that may be loosely dispersed, tightly arranged or mutually and randomly overlapping.

The diameter of fine particles to be used for the purpose of the present invention is between a tenth of several nanometers and hundreds of several nanometers and preferably between 1 nm and 20 nm. The thickness of the fine particle film is determined as a function of various factors as will be described in greater detail hereinafter, which include the conditions for establishing a good electric connection with the device electrodes 14 and 15, those for carrying out an energization forming process successfully and those for obtaining an appropriate value for the electric resistance of the fine particle film itself. Specifically, it is between a tenth of several nanometers and hundreds of several nanometers and preferably between 1 nm and 50 nm.

The electroconductive film 16 is made of fine particles of a material selected from metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge and carbon.

The electroconductive film 16 is made of fine particle film and normally shows a sheet resistance between $10^3$ and $10^7$ [Ω/□].

Note that the electroconductive film 16 and the device electrodes 14 and 15 are arranged to realize a stepped coverage relative to each other. While the device electrodes 14 and 15 are arranged on the substrate 13 and then the electroconductive film 16 is laid to partly cover the device electrode 14 and 15 in FIGS. 5A and 5B, if desired, the device electrodes may alternatively be laid on the electroconductive film.

The electron-emitting region 17 is part of the electroconductive film 16 and comprises one or more than one electrically highly resistive gaps, which may typically be fissures that are produced as a result of an energization process, which will be described hereinafter. The fissure may contain fine particles with a diameter between a tenth of several nanometers and tens of several nanometers. FIGS. 5A and 5B show the electron-emitting region 17 only schematically because there is no way for exactly knowing the location and the profile of the electron-emitting region 17.

The thin film 18 is made of carbon or a carbon compound and covers the electron-emitting region 17 and its vicinity. The thin film 18 is produced as a result of an energization activation process conducted after an energization forming process as will be described in greater detail hereinafter.

The thin film 18 is made of monocrystalline graphite, polycrystalline graphite, noncrystalline carbon or a combination of any of them. The thickness of the thin film 18 is less than 50 nm and preferably less than 30 nm.

Again, the thin films 18 is illustrated only schematically in FIGS. 5A and 5B because there is no way for exactly knowing the locations and the profiles thereof.

While the basic configuration of a surface-conduction electron-emitting device is described above, devices as described below are used in the current mode of carrying out the invention.

The substrate 13 is made of soda lime glass and the device electrodes 14 and 15 are made of Ni thin film. The device electrodes has a thickness d of 100 nm and are separated by a distance L of 2 μm.

The fine particle film contains Pd or PdO as principal ingredient and has a thickness of about 10 nm and a width W of 100 μm.

Now, a method of manufacturing a plane type surface conduction electron-emitting device that can suitably be used for the purpose of the invention will be described by referring to FIGS. 6A through 6E, which show schematic sectional side views of a surface conduction electron-emitting device in different manufacturing steps. The components of the device are denoted respectively by the same reference numerals as those of FIGS. 5A and 5B.

Figure 6A:
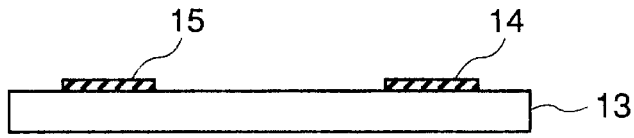
FIGS. 6A, 6B, 6C, 6D and 6E are schematic cross sectional views of a plane type surface conduction electron-emitting device to be used in an image-forming apparatus according to the invention, showing different manufacturing steps.
Figure 6B:
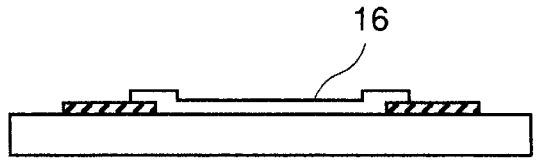

1) After thoroughly cleansing a substrate 13 with detergent, pure water and organic solvent, the material of a pair of device electrodes are deposited on the substrate 13 by deposition. (The material can be deposited by evaporation, sputtering or some other film forming technique using vacuum.) Thereafter, a pair of device electrodes 14 and 15 are produced, as shown in FIG. 6A, by patterning involving the use of the technique of photolithography and etching.
2) Then, as shown in FIG. 6B, an electroconductive thin film 16 is formed on the substrate 13. More specifically, a fine particle film is formed by applying an organic metal solution on the substrate 13 carrying a pair of device electrodes 14 and 15, drying it and thereafter baking it. Then, the film is made to show a desired pattern by photolithography and etching.

The organic metal solution may contain as principal ingredient any of the metals listed above for the electroconductive film. Pd was used as principal ingredient in the examples described hereinafter. While the organic metal solution was applied by dipping, some other technique such as the one using a spinner or a sprayer may alternatively be used.

An electroconductive film of fine particles may be formed by means of vacuum evaporation, sputtering or chemical vapor phase deposition in place of the above described application of the organic metal solution.

Figure 6C:
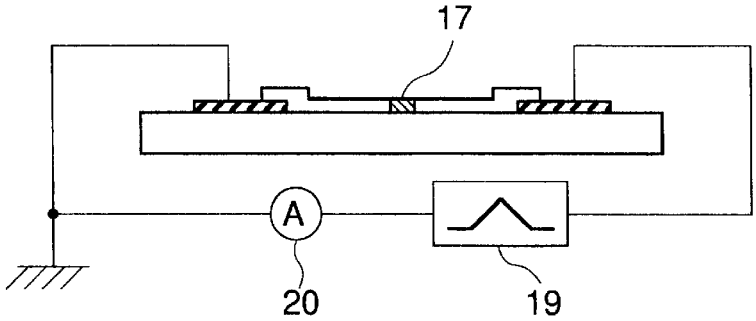

3) Thereafter, the electroconductive film is subjected to an energization forming process, where an appropriate voltage is applied between the device electrodes 14 and 15 from a forming power source 19 to produce an electron-emitting region 17 as shown in FIG. 6C.

In the energization forming process, the electroconductive film 16 made of fine particle film is electrically energized and locally destroyed, deformed or transformed to produce an area having a structure adapted to emit electrons. The area forced to show a structure adapted to emit electrons (or the electron-emitting region 17) has one or more than one fissures in the thin film. Note that the electric resistance between the device electrodes 14 and 15 dramatically rises once an electron-emitting region 17 is produced in the electroconductive film.

Figure 7:
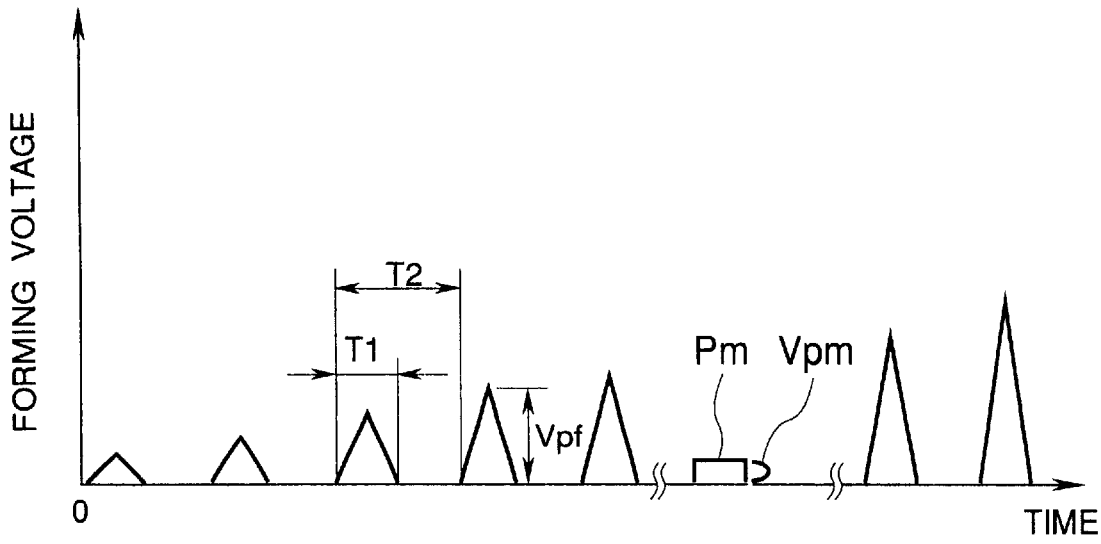
FIG. 7 is a graph showing a pulse voltage that can be applied to an electron beam source being formed for an image-forming apparatus according to the invention.

FIG. 7 shows the waveform of a voltage that can suitably be applied to the device electrodes from a forming power source 19 for energization forming for the purpose of the invention. A pulse voltage is advantageously be used for the process of energization forming to be conducted on an electroconductive film that is made of fine particle film. In the examples as will be described hereinafter, a triangular pulse voltage having a pulse width T1 as shown in FIG. 7 was applied with a pulse interval T2 in the course of manufacturing a surface conduction electron-emitting device. The height Vpf of the triangular pulse voltage was gradually raised. A monitoring pulse Pm was inserted into the triangular pulse at appropriate regular intervals and the electric current was observed by means of an ammeter 20 in order to monitor the progress in the formation of the electron-emitting region 17.

In the examples as will be described hereinafter, the pulse width T1 and the pulse interval T2 were 1 msec. and 10 msec., respectively, whereas the pulse wave height Vpf was raised by 0.1V by each pulse in vacuum of a degree of about $10^{-3}$ Pa. The monitoring pulse Pm was inserted at every five pulses of the triangular wave. A voltage Vpm of 0.1V was used for the monitor pulse so that no adverse effect of the monitoring pulse might be observed in the process of energization forming. The electric energization for the energization forming process was terminated when the electric resistance between the device electrodes 14 and 15 rose to $1\times10^{6}$ Ω or the current observed on the ammeter 20 fell below $1\times10^{-7}$ A while the monitoring pulse was being applied.

While preferable energization forming procedures are described above for a surface conduction electron-emitting device, the conditions for energization forming may preferably be modified appropriately when the material and the film thickness of the fine particle film, the distance between the device electrodes and/or other elements of the surface conduction electron-emitting device are changed.

4) After the energization forming operation, the device is subjected to an energization activation process to improve the electron-emitting performance of the device.

Figure 6D:
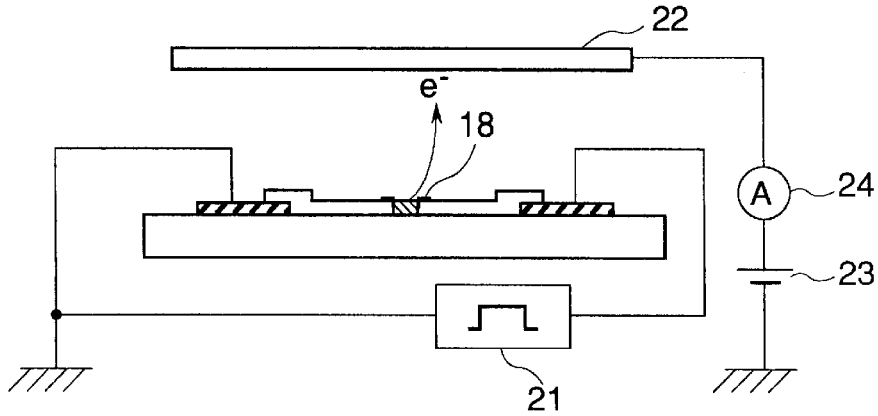

The activation process is a process in which the electron-emitting region 17 produced by the energization forming process is electrically energized to deposit carbon or a carbon compound on and near the electron-emitting region. In FIG. 6D, the deposits of carbon or a carbon compound are schematically shown as members 18. As a result of an energization activation process, the emission current of the device is typically raised by more than 100 times for a same voltage applied thereto if compared with the emission current of the device before the energization activation process.

More specifically, in an activation process, a pulse voltage may be periodically applied to the device in a vacuum of $10^{-a}$ Pa to $10^{-4}$ Pa in order to deposit carbon or a carbon compound originating from the organic compounds remaining in the vacuum. The deposits 18 are those of monocrystalline graphite, polycrystalline graphite, noncrystalline carbon or a mixture of any of them and have a film thickness less than 50 nm and preferably less than 30 nm.

Figure 8A:
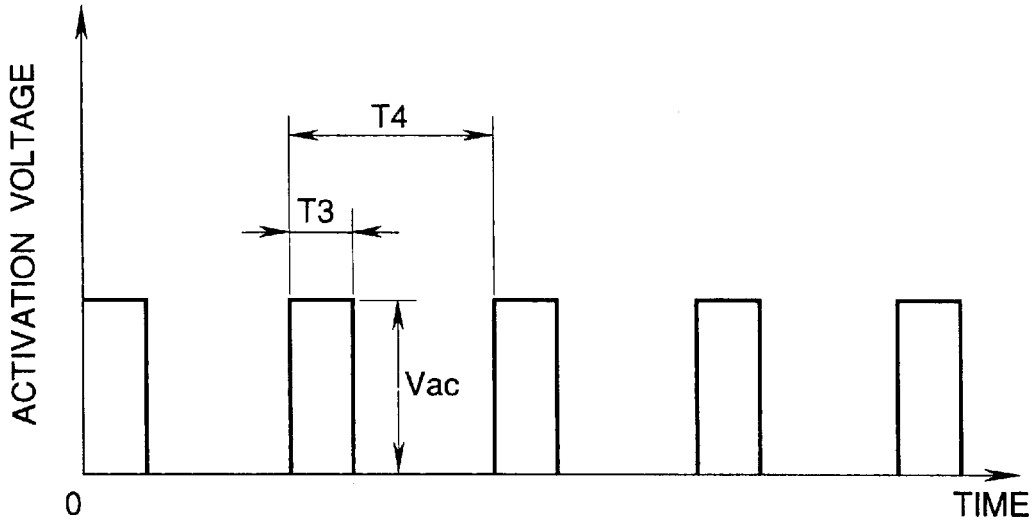
FIGS. 8A and 8B are graphs showing two alternative waveforms of a pulse voltage that can be used for an energization activation process for the purpose of the invention.

FIG. 8A shows the waveform of a pulse voltage that can be applied to a surface conduction electron-emitting device from the activation power source 21 for the purpose of the invention. In the examples of manufacturing a surface conduction electron-emitting device as will be described hereinafter, a rectangular pulse voltage having a constant pulse wave height was used for the energization activation process. The pulse wave height Vac, the pulse width T3 and the pulse interval T4 of the rectangular pulse voltage were respectively 14V, 1 msec. and 10 msec. While the above values of pulse voltage are selected for manufacturing a surface conduction electron-emitting device in the current mode of manufacturing carrying out the invention, a different set of figures will have to be selected for manufacturing a surface conduction electron-emitting device having a different configuration.

In FIG. 6D, a DC high voltage power source 23 and an ammeter 24 are connected to the anode 22 for seizing the emission current Ie emitted from the surface conduction electron-emitting device. If the activation process is carried out after installing the substrate 13 in the display panel, the fluorescent plane of the display panel is used as anode 22.

Figure 8B:
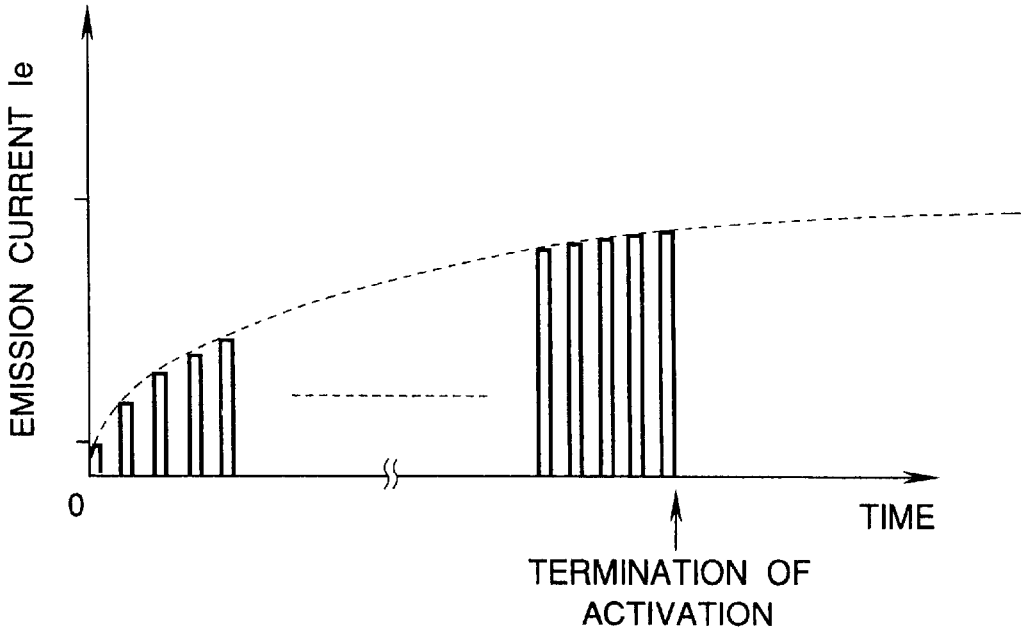

While a voltage is applied to the device from the activation power source 21, the progress of the energization-activation process is monitored by observing the emission current Ie by means of the ammeter 24 to control the operation of the activation power source 21. FIG. 8B shows the emission current Ie observed by means of the ammeter 24. As a pulse voltage is applied to the device from the activation power source 21, the emission current Ie rises with time until it gets to a saturation point, after which the emission current substantially remains on a constant level. The energization-activation process is terminated by suspending the voltage application from the activation power source 21 when the emission current Ie gets to the saturation point.

Note again, while the above values of pulse voltage are selected for manufacturing a surface conduction electron-emitting device in the current mode of carrying out the invention, a different set of figures will have to be selected for manufacturing a surface conduction electron-emitting device having a different configuration.

Figure 6E:
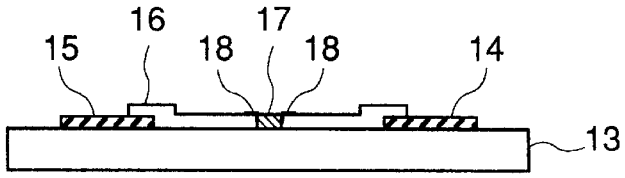

Thus, in this way, a plane type surface conduction electron-emitting device having a configuration as shown in FIG. 6E is produced.

(Step Type Surface Conduction Electron-Emitting Device)

Figure 9:
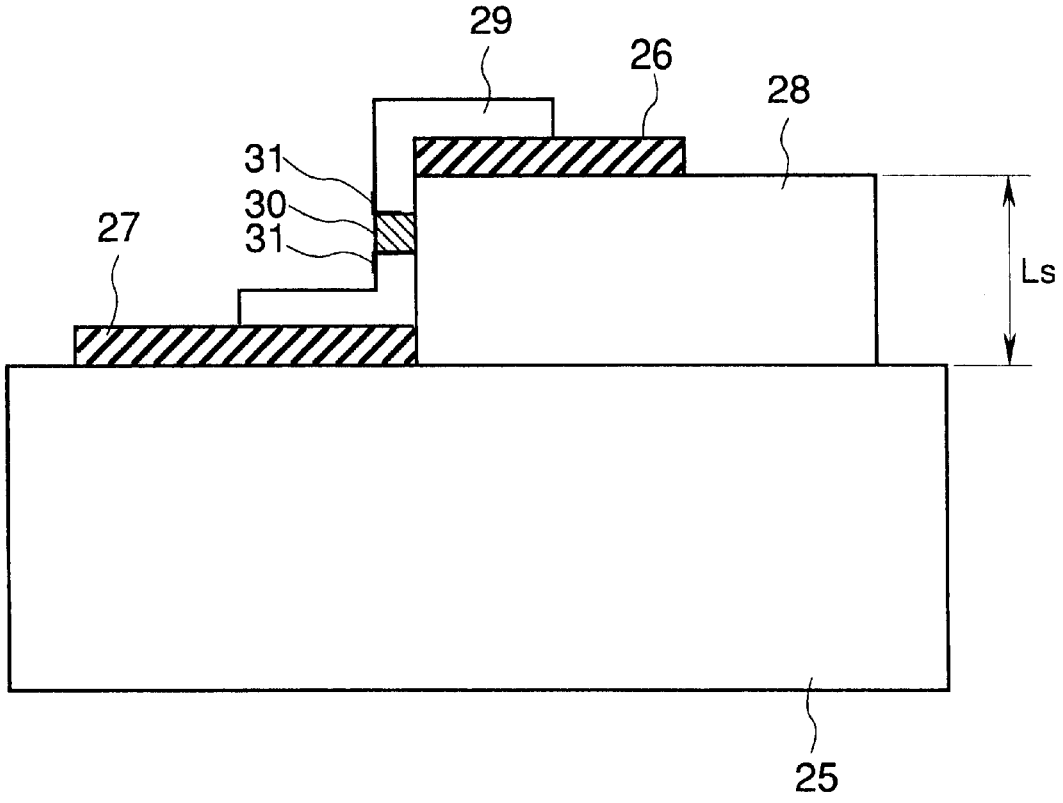
FIG. 9 is a schematic cross sectional view of a step-type surface conduction electron-emitting device to be used in an image-forming apparatus according to the invention.

FIG. 9 is a schematic sectional side view of a step type surface conduction electron-emitting device, showing its basic configuration having an electron-emitting region and neighboring areas made of fine particle film. Referring to FIG. 9, it comprises a substrate 25, a pair of device electrodes 26 and 27, a step-forming section 28, an electroconductive film 29 made of fine particle film, an electron-emitting region 30 formed by an energization forming process and a thin film 31 formed by an energization activation process.

This step type surface conduction electron-emitting device differs from the above described plane type surface conduction electron-emitting device in that one of the device electrodes, or electrode 26, is arranged on the step-forming section 28 and the electroconductive film 29 covers a lateral surface of the step-forming section 28. Thus, the height Ls of the step-forming section 28 of this step type surface conduction electron-emitting device corresponds to the distance L between the device electrodes of the plane type surface conduction electron-emitting device. The substrate 25, the device electrodes 26 and 27 and the electroconductive film 29 comprising fine particle film of a step type surface conduction electron-emitting device may be made of any of the materials respectively listed earlier for their counterparts of a plane type surface conduction electron-emitting device. The step-forming section 28 is typically made of an electrically insulating material such as $SiO_2$.

(Characteristics of a Surface-Conduction Electron-Emitting Device Used in a Display Apparatus)

A plane or step type surface conduction electron-emitting device prepared in a manner as described above shows the following characteristic features.

Figure 10:
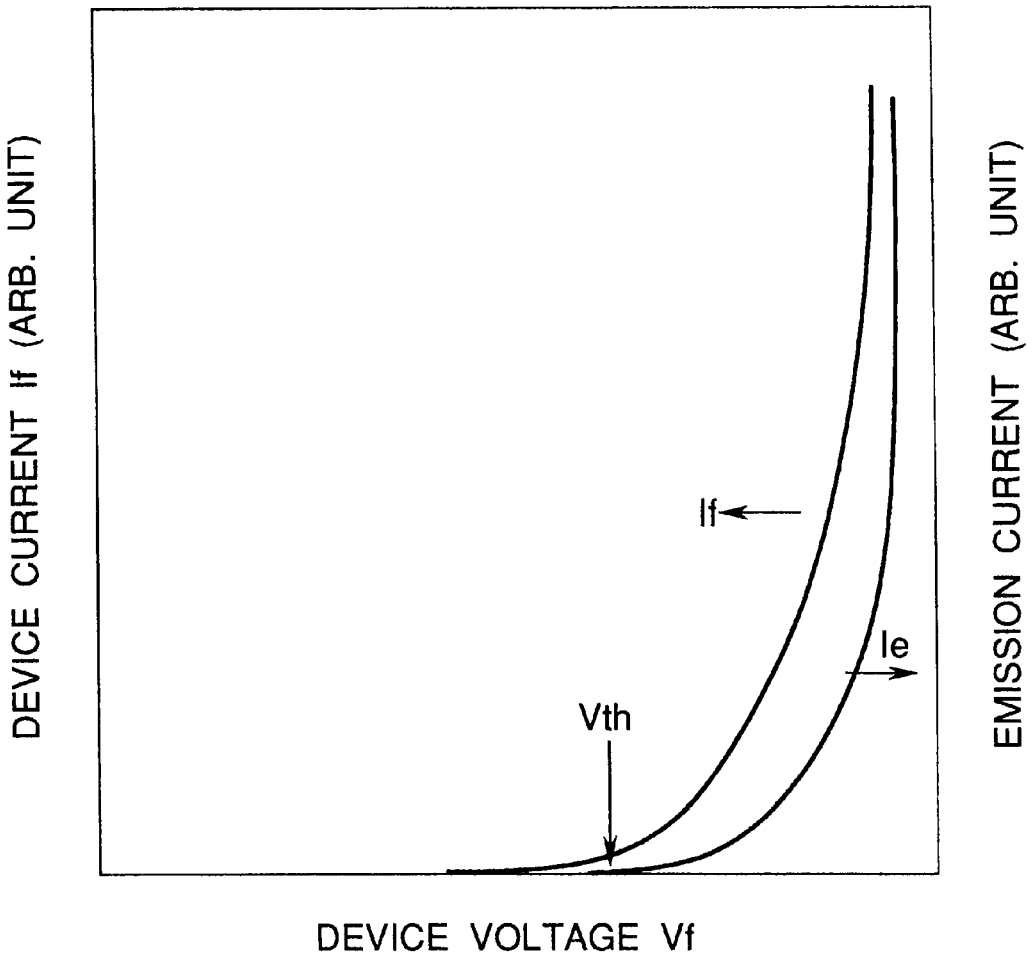
FIG. 10 is a graph showing the current-voltage characteristic of a surface-conduction electron-emitting device that can be used for the purpose of the invention.

FIG. 10 shows a graph schematically illustrating the relationship of (the device voltage Vf) and (the emission current Ie) and that of (the device voltage Vf and the device current If). Note that different units are arbitrarily selected for the emission current Ie and the device current If in FIG. 10 in view of the fact that the emission current Ie has a magnitude by far smaller than that of the device current If so that a same scale cannot be used for them and that the relationships can vary significantly depending on the profile of the device and the design parameters.

An electron-emitting device to be used for an image-forming apparatus according to the invention has three remarkable characteristic features in terms of emission current Ie, which will be described below.

Firstly, the electron-emitting device shows a sudden and sharp increase in the emission current Ie when the voltage applied thereto exceeds a certain level (which is referred to as a threshold voltage Vth hereinafter), whereas the emission current Ie is practically undetectable when the applied voltage is found lower than the threshold value Vth. Differently stated, the electron-emitting device is a non-linear device having a clear threshold voltage Vth relative to the emission current Ie.

Secondly, since the emission current Ie varies depending on the device voltage Vf, the former can be effectively controlled by way of the latter.

Thirdly, the electric charges of electrons emitted from the device can be controlled by controlling the time during which the device voltage Vf is applied because the emission current Ie quickly responds to the device voltage Vf.

Because of the above remarkable characteristic features, an effective display apparatus can be formed by using such surface conduction electron-emitting devices. For example, in a display apparatus comprising a large number of surface conduction electron-emitting devices in correspondence to pixels, images can be displayed by sequentially scanning the display screen, exploiting the above identified first characteristic feature. With such a display apparatus, a voltage above the threshold voltage Vth is applied to each of the devices selected for being driven as a function of the desired luminance of emitted light, while a voltage below the threshold voltage Vth is applied to each of the unselected devices. The display screen can be sequentially scanned to display images by selecting devices to be driven also in a sequential manner. Additionally, images with delicate tones can be displayed by controlling the luminance of emitted light, exploiting the above identified second and third characteristic features.

(The Configuration of a Multi-Electron-Beam Source Comprising a Large Number of Devices and a Simple Matrix Wiring Arrangement)

Now, a multi-electron-beam source comprising a large number of surface-conduction electron-emitting devices arranged on a substrate and provided with simple matrix wiring will be described.

Figure 11:
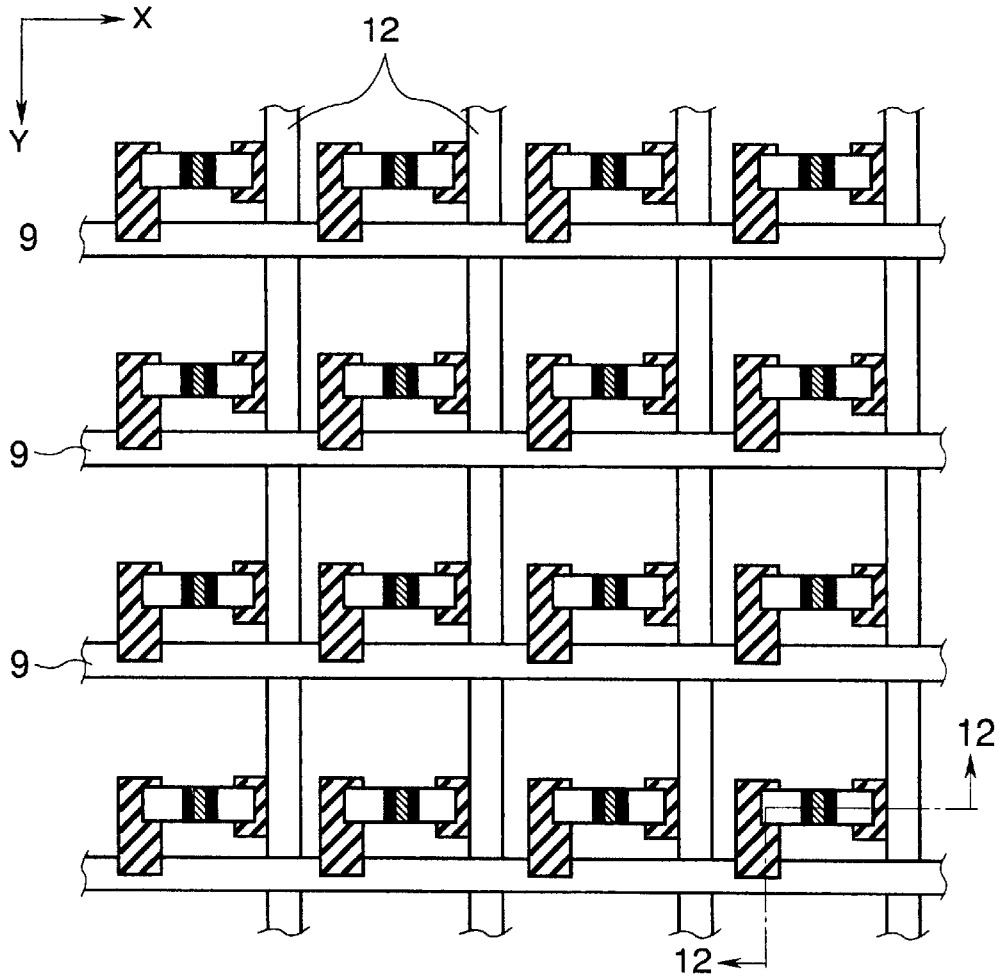
FIG. 11 is a simple matrix wiring arrangement that can be used for the purpose of the invention.
Figure 12:
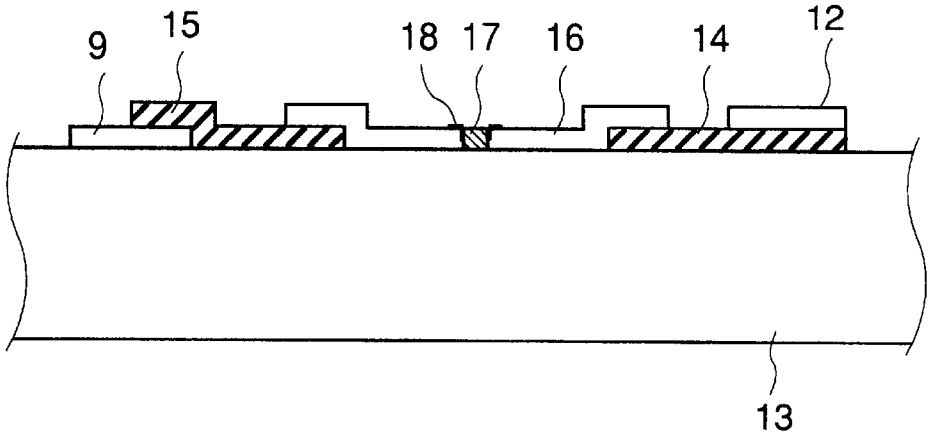
FIG. 12 is a schematic cross sectional view of a flat-type surface-conduction electron-emitting device that can be used with a simple matrix wiring arrangement for the purpose of the invention.

FIG. 11 is a plan view of a schematic plan view of a multi-electron-beam source to be used for a display panel of FIG. 2. A number of surface-conduction electron-emitting devices having a configuration as shown in FIGS. 5A and 5B are arranged in array on a substrate and connected to corresponding X-directional wire electrodes 9 and corresponding Y-directional wire electrodes 12, which provide simple matrix wiring arrangement. An insulation layer (not shown) is arranged at each of the crossings of the X-directional wire electrodes 9 and the Y-directional wire electrodes 12 to electrically isolate the electrodes. FIG. 12 is a cross sectional view taken along line 12—12 in FIG. 11.

A multi-electron-beam source having a configuration as described above can be prepared by forming X-directional wire electrodes 9, Y-directional wire electrodes 12, an inter-electrode insulation layer (not shown) and device electrodes and electroconductive thin films for surface-conduction electron-emitting devices on a substrate and subjecting the surface-conduction electron-emitting devices to an energization forming process and an energization activation process by feeding them respectively with power via the X-directional wire electrodes 9 and the Y-directional wire electrodes 12.

Now, the present invention will be described further by way of examples and by referring to the accompanying drawings.

EXAMPLE 1

Referring to FIG. 1, in this example, a plurality of surface-conduction type electron sources 1 that had not been subjected to energization forming were formed on a rear plate 2. More specifically, a total of 160×720 of surface-conduction electron-emitting devices having a configuration as shown in FIG. 12 were formed to produce a matrix on a rear plate 2 which was made of a clean soda lime glass. The device electrodes 14 and 15 were made of Ni film produced by sputtering and the X-directional wires 9 and the Y-directional wires 12 were made of Ag and produced by screen printing. The electroconductive thin film 16 of each device was made of PdO fine particle film produced by baking a Pd amine complex solution.

As shown in FIG. 4A, the flourescent film 5 that operated as image-forming member was formed by arranging stripe-shaped flourescent members 5*a* of the primary colors in parallel along the Y-direction that were separated by black stripes 5*b*. Black stripes 5*b* were arranged not only in the Y-direction to separate adjacently located fluorescent members 5*a* but also in the X-direction in order to separate the pixels that were arranged in the Y-direction. The black stripes 5*b* were so configured that they could accommodate respective spacers 10 thereon. More specifically, the (electroconductive) black stripes 5*b* were formed first and then fluorescent materials of the primary colors were applied to the respective gaps of the black stripes 5*b* to produce the fluorescent members 5*a* of the primary colors. The black stripes 5*b* were made of a material containing graphite as principal ingredient that was popularly used for black stripes. The fluorescent materials were applied to the glass substrate 4 by means of a slurry technique.

After preparing the fluorescent film 5, the inner surface of the fluorescent film 5 was smoothed (in a process normally referred to filming) and then the metal back 6 was formed on the inner surface (on the side closer to the electron sources) of the fluorescent film 5 by vacuum evaporation of aluminum. While a transparent electrode may be formed on the outer side of the fluorescent film 5 on the face plate 7 (between the glass substrate and the fluorescent film) in order to improve the electroconductivity of the fluorescent film 5, no such electrode was formed in this example because the metal back provided a sufficient level of electroconductivity.

Each of the spacers 10 was prepared by forming a silicon nitride film to a thickness of 0.5 μm as an Na block layer 10*b* on an insulating substrate 10*a* (3.8 mm wide, 200 μm thick and 20 mm long) made of clean soda lime glass and then forming a film of nitride of Cr/Al alloy 10*c* thereon.

Figure 14:
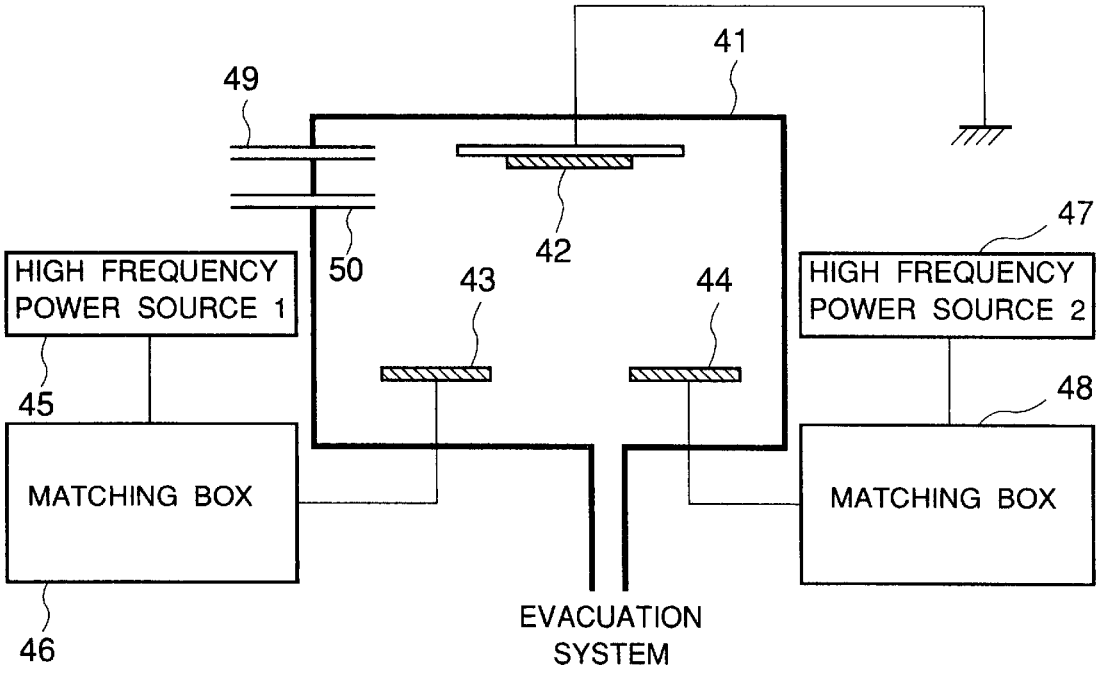
FIG. 14 is a schematic block diagram of a sputtering system.
Figure 15:
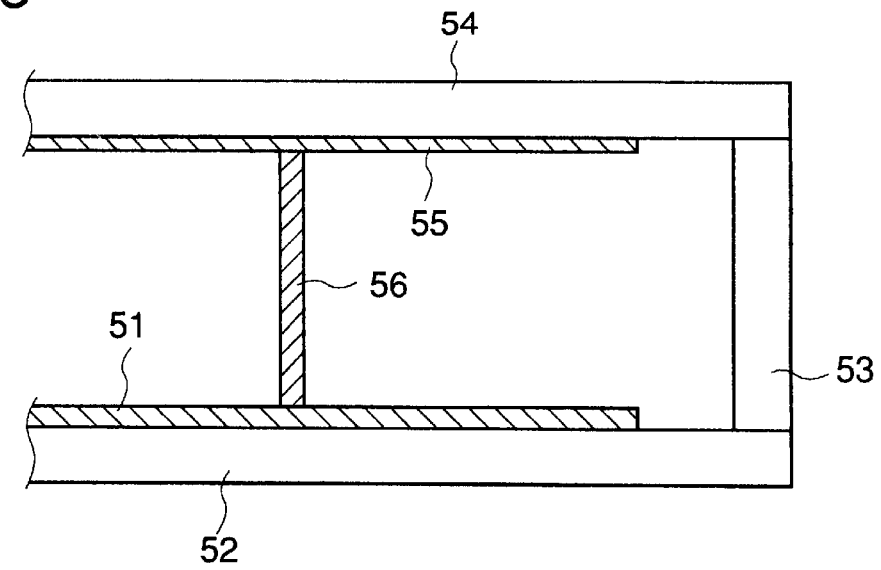
FIG. 15 is a schematic cross sectional view of a display apparatus according to the invention and comprising a large number of minute electron sources.

The Cr/Al nitride film of this example was produced by sputtering Cr and Al targets simultaneously in an atmosphere of a mixture of argon and nitrogen by means of a sputtering system. FIG. 14 schematically shows the sputtering system used for this example. Referring to FIG. 14, there are shown a film forming chamber 41, a spacer member 42, Cr and Al targets 43 and 44, high frequency power sources 45 and 47 for applying a high frequency voltage to the respective targets 43 and 44, matching boxes 46 and 48 and feed pipes 49 and 50 for feeding respectively argon and nitrogen.

Argon and nitrogen were fed into the film forming chamber 41 to show respective partial pressures of 0.5 Pa and 0.2 Pa and a high frequency voltage was applied to each of the targets and the spacer substrate to give rise to an electric discharge for sputtering. The composition of the deposited film was modified by regulating the powers fed to the respective targets to achieve an optimal resistance. The following three different Cr/Al nitride films were prepared in this example for three sets of spacers.

(1) The Al target and the Cr target were fed respectively with 500 W and 25 W for 4 minutes. The film thickness was 43 nm and the as depo specific resistance was 2.5 Ωm.

(2) The Al target and the Cr target were fed respectively with 500 W and 12 W for 20 minutes. The film thickness was 200 nm and the as depo specific resistance was $2.4\times10^3$ Ωm.

(3) The Al target and the Cr target were fed respectively with 500 W and 10 W for 8 minutes. The film thickness was 80nm and the as depo specific resistance was $4.5\times10^6$ Ωm.

Then, an image-forming apparatus comprising the respective set of spacers was prepared. In order to establish a reliable electric connection between each of the spacers 10, the related X-directional wire and the metal back, an Al electrode 11 was formed on the junctioning area of the spacer 10. The electrode 11 also covered the four lateral sides of the spacer 10 that was exposed to the inside of the envelope 8 by 50 μm from the X-directional wire toward the face plate and by 300 μm from the metal back toward the rear plate. Note, however, that such an electrode 11 may be omitted if a reliable electric connection is established without using it. The spacers 10 coated with a Cr/Al nitride film 10*c* were then secured to the face plate 7 at regular intervals.

Thereafter, the face plate 7 was arranged 3.8 mm above the electron sources 1 with the support frame (lateral walls) 3 interposed therebetween and the rear plate 2, the face plate 7, the support frame 3 and the spacers 10 were firmly bonded at the junctions thereof.

More specifically, frit glass was applied to the rear plate 2 and the support frame 3 at the junctions thereof and also to the face plate 7 and the support frame 3 at the junctions thereof (while electroconductive frit glass was used to the junctions of the spacers and the face plate) and they were airtightly bonded to each other by baking them at 430° C. for more than 10 minutes in a nitrogen atmosphere in order to prevent the nitride film of aluminum and transition metal on the surface of the spacers from being oxidized. Electroconductive frit glass containing Au-coated silica pellets was applied to the black stripes 5*b* (width: 300 μpm) on the face plate 7 in order to establish an electric connection between the charge-reducing film on the spacers and the face plate 7. The metal back was partly removed in areas where it abuts the spacers.

The inside of the prepared envelope 8 was then evacuated through an exhaust pipe by means of a vacuum pump to establish satisfactory low pressure therein and subsequently a voltage was applied to the device electrodes 14, 15 of the electron-emitting devices 1 by way of the external terminals Dx1–Dxm and Dy1–Dyn of the container in order to produce an electron-emitting region 17 in each of the electron-emitting devices 1 in an energization forming process. FIG. 7 shows the waveform of the voltage used in the energization forming process.

Then, acetone was introduced into the vacuum container by way of the exhaust pipe until the internal pressure got to 0.133 Pa. Thereafter, an energization activation process was conducted to deposit carbon or a carbon compound by periodically applying a voltage pulse to the device electrodes by way of the external terminals Dx1–Dxm and Dy1–Dyn of the container. FIG. 8A shows the waveform of the voltage used in the energization activation process.

Subsequently, the entire container was heated to 200° C. for 10 hours to completely evacuate the inside to a pressure level of about $10^{-4}$ Pa and then the exhaust pipe was closed by heating and melting it by means of a gas burner to airtightly seal the envelope B.

Finally, the container was subjected to a gettering process to maintain the vacuum in the inside after the sealing.

Scan signals and modulation signals were applied from a signal generating means (not shown) to the electron-emitting devices 1 of the finished image-forming apparatus by way of the external terminals Dx1–Dxm and Dy1–Dyn to cause them to emit electrons, while a high voltage was applied to the metal back 6 by way of the high voltage terminal Hv to accelerate the emitted electrons and cause them to collide with the fluorescent film 5 in order to make the fluorescent members excite and emit light to display images. The voltage Va applied to the high voltage terminal Hv was between 1 kV and 5 kV and the voltage Vf applied between the device electrodes 14, 15 of each of the electron-emitting devices 1 was 14V.

Table 1 below shows the resistance of the charge-reducing film 10*c* of the spacers 10 and its performance obtained in the examples.

As shown in Table 1, the resistance was observed after the film formation and after the panel preparation to prove that practically no fluctuations were observed in the resistance throughout the entire processes. This fact indicates that the Cr/Al nitride film was very stable and operated excellently as a charge-reducing film.

When the image-forming apparatus provided with the spacers having a specific resistance of $2.4\times10^3$ Ωm was driven to operate, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances that could divert electrons from their due courses and the spacers were not electrically charged at all. The temperature coefficient of resistance of the used material was −0.3% and no thermal runaway was observed at Va=5 kV.

A voltage exceeding 2 kV could not applied to the spacers with a specific resistance of 2.5 Ωm because the power consumption rate almost got to 1 W at Va=2 kV. While the spacers with a specific resistance as large as $4.5\times10^6$ Ωm did not show any thermal runaway, their charge-reducing effect was weak and disturbed images were displayed as some electron beams were drawn toward the spacers.

As a result of XPS (X-ray photoelectron spectrometer) observation, the nitridation degrees (the ratio of the concentration of aluminum atoms of the aluminum nitride/the concentration of aluminum atoms) of the specimens of this example were found to be 78, 77 and 73% respectively.

COMPARATIVE EXAMPLE 1

For comparison, the Cr/Al nitride film was replaced by $SnO_2$ film, using the same procedures as Example 1 (as depo resistance: $6.7\times10^8$ Ω, film thickness: 5 nm). FIG. 14 shows the sputtering system used for this comparative example. The metal sputtering targets were replaced by an $SnO_2$ target. Only argon gas was used for a total pressure of 0.5 Pa in the sputtering process, for which power was supplied at a rate of 500 W for five minutes.

The electroconductive film 10*c* showed remarkable fluctuations throughout the assembling steps. After the assembling steps, the specific resistance and the resistance were respectively $9.2\times10^{-2}$ Ωm and $1.8\times10^6$ Ω and hence Va could not be raised to 1 kV. In other words, the resistance fluctuated remarkably in an undefinable way during the process of manufacturing the display so that the resistance could vary greatly when the process is over. Therefore, there was no way for controlling the resistance. Additionally, an $SnO_2$ film having such a specific resistance value had to be made as thin as less than 1 nm to make the resistance even more uncontrollable.

EXAMPLE 2

This example differed from Example 1 in that the Cr/Al nitride film 10*c* of the spacers 10 of Example 1 was replaced by a Ta/Al nitride film in this example. The Ta/Al nitride film of this example was produced by sputtering Ta and Al targets simultaneously in an atmosphere of a mixture of argon and nitrogen by means of a sputtering system. FIG. 14 schematically shows the sputtering system used for this example. Argon and nitrogen were fed into the film forming chamber 41 to show respective partial pressures of 0.5 Pa and 0.2 Pa and a high frequency voltage was applied to each of the targets and the spacer substrate to give rise to an electric discharge for sputtering. The composition of the deposited film was modified by regulating the powers fed to the respective targets to achieve an optimal resistance.

A Ta/Al nitride film was prepared by feeding the Al target and the Ta target respectively with 500 W and 150 W for 11 minutes. The film thickness was about 150 nm and the as depo specific resistance was $6.2\times10^3$ Ωm. The temperature coefficient of resistance was −0.04%.

Then, an image-forming apparatus was prepared by using the above described spacers 10 and operated for evaluation as in Example 1.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers (as depo), after bonding them to the face plate, after bonding them to the rear plate and after the evacuation and each of the energization processes to prove that practically no fluctuations were observed in the resistance throughout the entire processes.

Then, the resistance was observed in minute areas of the spacers including those located close to the rear plate and those close to the face plate but no significant difference was observed in the resistance after the entire assembling process to prove that the film had a uniform resistance distribution. When the image-forming apparatus comprising the spacers was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all.

EXAMPLE 3

This example differed from Example 1 in that the Cr/Al nitride film 10*c* of the spacers 10 of Example 1 was replaced by a Ti/Al nitride film in this example. The Ti/Al nitride film of this example was produced by sputtering Ti and Al targets simultaneously in an atmosphere of a mixture of argon and nitrogen by means of a sputtering system. FIG. 14 schematically shows the sputtering system used for this example. Argon and nitrogen were fed into the film forming chamber 41 to show respective partial pressures of 0.5 Pa and 0.2 Pa and a high frequency voltage was applied to each of the targets to give rise to an electric discharge for sputtering. The composition of the deposited film was modified by regulating the powers fed to the respective targets to achieve an optimal resistance.

The following two different Ti/Al nitride films were prepared in this example for two sets of spacers. The temperature coefficient of resistance was −0.4%.

(1) The Al target and the Ti target were fed respectively with 500 W and 120 W for 6 minutes. The film thickness was 60nm and the specific resistance was $5.5\times10^3$ Ωm.

(2) The Al target and the Ti target were fed respectively with 500 W and 80 W for 8 minutes. The film thickness was 80nm and the specific resistance was $1.9\times10^5$ Ωm.

Then, image-forming apparatus comprising respective sets of spacers were prepared and operated for evaluation as in Example 1.

Scan signals and modulation signals were applied from a signal generating means (not shown) to the electron-emitting devices 1 of the finished image-forming apparatus by way of the external terminals Dx1–Dxm and Dy1–Dyn to cause them to emit electrons, while a high voltage was applied to the metal back 6 by way of the high voltage terminal Hv to accelerate the emitted electrons and cause them to collide with the fluorescent film 5 in order to make the fluorescent members excite and emit light to display images.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers (as depo), after bonding them to the face plate, after bonding them to the rear plate and after the evacuation and each of the energization processes to prove that practically no fluctuations were observed in the resistance throughout the entire processes.

Then, the resistance was observed in minute areas of the spacers including those located close to the rear plate and those close to the face plate but no significant difference was observed in the resistance after the entire assembling process to prove that the film had a uniform resistance distribution. When the image-forming apparatus comprising the spacers with $5.5\times10^3$ Ωm was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all. On the other hand, electron beams were slightly deviated near the spacers in the image-forming apparatus comprising the spacers with a greater specific resistance (specific resistance: $1.9\times10^5$ Ωm) to display slightly distorted images.

EXAMPLE 4

This example differed from Example 1 in that the Cr/Al nitride film 10*c* of the spacers 10 of Example 1 was replaced by a Mo/Al nitride film in this example.

Argon and nitrogen were fed to show respective partial pressures of 0.31 Pa and 0.14 Pa and a 200 nm thick Mo/Al nitride films were prepared by feeding the Al target and the Mo target respectively with 500 W and three different levels of 3 W, 6 W and 9 W for 20 minutes to produce three different films for three different sets of spacers. The specific resistances of the three different specimens of Mo/Al nitride film were $8.4\times10^5$ Ωm, $5.2\times10^4$ Ωm and $6.4\times10^3$ Ωm and the temperature coefficient of resistance was −0.3%.

Then, image-forming apparatus comprising respective sets of spacers were prepared and operated for evaluation as in Example 1. Table 1 shows some of the characteristics and the performance of the spacers. The spacers proved that practically no fluctuations were observed in the resistance throughout the entire processes of manufacturing the image-forming apparatus.

When the image-forming apparatus provided with the spacers other than those having a low Mo content were driven to operate, rows of light emitting spots including those due to electrons emitted from the electron-emitting devices 1 located close to the spacers were formed and spread two-dimensionally at regular intervals so that very clear and reproducible color images were displayed. On the other hand, in the image-forming apparatus comprising the spacers with a low Mo content, electron beams were drawn by the spacers. In any case, no thermal runaway was observed at Va=5 kV.

EXAMPLE 5

This example differed from Example 1 in that the Cr/Al nitride film 10*c* of the spacers 10 of Example 1 was replaced by a W/Al nitride film in this example.

A 200 nm thick W/Al nitride films were prepared by feeding the Al target and the Mo target respectively with 500 W and four different levels of 7 W, 9 W, 11 W and 20 W for 21 minutes to produce four different films for four different sets of spacers. The specific resistances of the four different specimens of W/Al nitride film were $1.3\times10^5$ Ωm, $4.2\times10^4$ Ωm, $6.5\times10^3$ Ωm and 110 Ωm and the temperature coefficient of resistance was −0.3%.

Then, image-forming apparatus comprising respective sets of spacers were prepared and operated for evaluation as in Example 1. Table 1 shows some of the characteristics and the performance of the spacers. The spacers proved that practically no fluctuations were observed in the resistance throughout the entire processes of manufacturing the image-forming apparatus.

When the image-forming apparatus provided with the spacers other than those having a low W content were driven to operate, rows of light emitting spots including those due to electrons emitted from the electron-emitting devices 1 located close to the spacers were formed and spread two-dimensionally at regular intervals so that very clear and reproducible color images were displayed. On the other hand, in the image-forming apparatus comprising the spacers with a low W content, electron beams were drawn by the spacers. While the spacers with the highest W content showed a thermal runaway with Va exceeding 4 kV, no thermal runaway was observed in the remaining spacers at Va=5 kV.

EXAMPLE 6

In this example, each of the spacers was prepared by forming a Cr/Si nitride film 10*c* on an insulating substrate 10*a* (3.8 mm wide, 200 μm thick and 40 mm long) made of clean soda lime glass.

The Cr/Si nitride film of this example was produced by sputtering Cr and Si targets simultaneously in an atmosphere of a mixture of argon and nitrogen by means of a sputtering system. The composition of the deposited film was controlled by regulating the powers fed to the respective targets to achieve an optimal resistance. The specific sputtering conditions were as follows. Argon and nitrogen partial pressures were 0.093 Pa and 0.040 Pa, while the Cr target and the Si target were fed respectively with 30–50 W and 600 W. The substrates were held to room temperature and grounded.

The sputtering system described in Example 1 was also used for this example. A high frequency voltage was applied to each of the targets a nd the spacers to give rise to an electric discharge for sputtering.

The following three different Cr/Si nitride films were prepared in this example for three sets of spacers; (1) film thickness: 40 nm, specific resistance: 42 Ωm, Cr target: 50 W, Cr/Si composition ratio 41.3 at. % (atom %), (2) film thickness: 210 nm, specific resistance: $2.6\times10^3$ Ωm, Cr target: 40 W, Cr/Si composition ratio 15 at. % and (3) film thickness: 100 nm, specific resistance: $6.0\times10^6$ Ωm, Cr target: 30 W, Cr/Si composition ratio 4.1 at. %.

Then, image-forming apparatus comprising the respective set of spacers were prepared. In order to establish a reliable electric connection between each of the spacers 10, the related X-directional wire and the metal back, an Al electrode 11 was formed on the junctioning area of the spacer 10. The electrode 11 also covered the four lateral sides of the spacer 10 that was exposed to the inside of the envelope 8 by 50 μm from the X-directional wire toward the face plate and by 300 μm from the metal back toward the rear plate. The spacers 10 coated with a Cr/Si nitride film 10*c* were then secured to the respective X-directional wires 9 at regular intervals Thereafter, the face plate 7 was arranged 3.8 mm above the electron sources 1 with the support frame (lateral walls) 3 interposed therebetween and the rear plate 2, the face plate 7, the support frame 3 and the spacers 10 were firmly bonded at the junctions thereof.

More specifically, frit glass was applied to the electron sources 1 and the rear plate 2 at the junctions thereof, to the rear plate 2 and the support frame 3 at the junctions thereof and also to the face plate 7 and the support frame 3 at the junctions thereof and they were airtightly bonded to each other by baking them at 430° C. for more than 10 minutes in a nitrogen atmosphere in order to prevent the silicon/transition metal nitride film on the surface of the spacers from being oxidized.

Finally, the container was subjected to a gettering process to maintain the vacuum in the inside after the bonding.

Scan signals and modulation signals were applied from a signal generating means (not shown) to the electron-emitting devices 1 of the finished image-forming apparatus that have been prepared in a manner as described above in Example 1 by way of the external terminals Dx1–Dxm and Dy1–Dyn to cause them to emit electrons, while a high voltage was applied to the metal back 6 by way of the high voltage terminal Hv to accelerate the emitted electrons and cause them to collide with the fluorescent film 5 in order to make the fluorescent members excite and emit light to display images. The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. For example, the resistance of the spacers with the specific resistance of $2.6\times10^3$ Ωm was $5.9\times10^8$ Ω before the installation, $2.4\times10^8$ Ω after bonding the face plate and the rear plate, $8.2\times10^8$ Ω after the evacuation and also $8.2\times10^8$ Ω after the device electrode energization processes. This fact indicates that the Cr/Si nitride film was very stable and operated suitably as charge-reducing film.

When the image-forming apparatus comprising the spacers with the specific resistance of $2.6\times10^3$ Ωm was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all. The temperature coefficient of resistance of this material was −0.7% and no thermal runaway was observed at Va=5 kV.

After taking out the spacers, the surface was observed through an XPS (X-ray photoelectron spectrometer) to find that Cr was in the form of oxide on the surface but Si existed in the form of a mixture of nitride and oxide and that the Si nitride ratio (the concentration of nitrogen atoms of the silicon nitride/the concentration of silicon atoms) was between 81 and 86%.

The spacers with the specific resistance of 42 Ωm showed a thermal runaway at Va=2 kV and hence it was impossible to apply 2 kV because of the disrupted charge-reducing film. While the spacers with the specific resistance as high as $6.0\times10^6$ Ωm did not show any thermal runaway, their charge-reducing effect was weak and the image-forming apparatus comprising them showed distorted images as electron beams were drawn to the spacers.

EXAMPLE 7

This example differed from Example 6 in that the bonding step was conducted not in a nitrogen atmosphere but in the atmosphere. (Otherwise, the manufacturing conditions for the spacers with the thickness of 210 nm and the specific resistance of $2.6\times10^3$ Ωm in Example 6 were used.) Then, each of the spacers 10 was prepared by forming a Cr/Si nitride film 10*c* to have a thickness of about 200 nm and show a specific resistance of $3.1\times10^3$ Ωm, a temperature coefficient of resistance of −0.9% and a composition ratio of Cr/Si=15 at. %.

Then, an image-forming apparatus comprising the spacers was prepared and operated for evaluation as in Example 1.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. However, electron beams were diverted by 100 to 200 μm near the spacers to show slightly disturbed images.

The resistance of the spacers was $7.4\times10^8$ Ω before the installation, $3.9\times10^8$ Ω after bonding the face plate and the rear plate, $9.2\times10^8$ Ω after the evacuation and also $9.1\times10^8$ Ω after the device electrode energization processes.

After taking out the spacers, the surface was observed through an XPS (X-ray photoelectron spectrometer) to find that the Si nitride ratio (the concentration of nitrogen atoms of the silicon nitride/the concentration of silicon atoms) was as low as between 50 and 56% to prove that the oxide existed to an enhanced proportion. This fact suggests that spacers are apt to be electrically charged to divert electrons from due courses when the content of Cr/Si nitride of the spacers is reduced to increase the oxide content.

However, there may be a range where the Si nitride ratio (the concentration of nitrogen atoms of the silicon nitride/the concentration of silicon atoms) is relatively low but does not affect electron beams.

EXAMPLE 8

This example differed from Example 6 in that the substrate was heated to 150° C. during the operation of forming a Cr/Si nitride film on each of the spacers by sputtering the Cr and Si targets simultaneously in an atmosphere of a mixture of argon and nitrogen and the subsequent bonding step was conducted not in a nitrogen atmosphere but in the atmosphere. (Otherwise, the manufacturing conditions for the spacers with the thickness of 210 nm and the specific resistance of $2.6\times10^3$ Ωm in Example 6 were used.) The substrate is preferably heated to temperature between 50° C. and 400° C. Each of the spacers 10 was prepared by forming a Cr/Si nitride film 10*c* to a thickness of about 200 nm to show a specific resistance of $3.0\times10^3$ Ωm, a temperature coefficient of resistance of −0.8% and a composition ratio of Cr/Si=14.8 at. %.

Then, an image-forming apparatus comprising the spacers was prepared and operated for evaluation as in Example 1.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. Specifically, the resistance of the spacers was $7.1\times10^8$ Ω before the installation, $3.2\times10^8$ Ω after bonding the face plate and the rear plate, $9.2\times10^8$ Ω after the evacuation and also $9.1\times10^8$ Ω after the device electrode energization processes.

Then, the resistance was observed in minute areas of the spacers including those located close to the rear plate and those close to the face plate but no significant difference was found in the resistance after the entire assembling process to prove that the film had a uniform resistance distribution. When the image-forming apparatus comprising the spacers was driven to operate at this stage, rows of light emitting spots including those due to electrons emitted from the electron-emitting devices 1 located close to the spacers were formed and spread two-dimensionally at reqular intervals so that very clear and reproducible color images were displayed. This fact indicates that the spacers 10 did not give rise to any disturbances in the electric field that could divert electrons from their due courses and the spacers were not electrically charged at all.

After taking out the spacers, the surface was observed through an XPS (X-ray photoelectron spectrometer) to find that Cr was in the form of oxide on the surface but Si existed in the form of a mixture of nitride and oxide and that the Si nitride ratio (the concentration of nitrogen atoms of the silicon nitride/the concentration of silicon atoms) was between 74 and 82%. This indicates that the bonding step can be conducted in the atmosphere without reducing the silicon nitride ratio if the substrate is heated to 150° C. in the preceding sputtering step for forming a Cr/Si nitride film on the spacer. A bonding step conducted in the atmosphere can significantly reduce the manufacturing cost.

EXAMPLE 9

This example differed from Example 8 in that RF biasing power was applied to the substrate by several watts during the operation of forming a Cr/Si nitride film on each of the spacers by sputtering the Cr and Si targets simultaneously in an atmosphere of a mixture of argon and nitrogen. The specific sputtering conditions were as follows. Argon and nitrogen partial pressures were 0.093 Pa and 0.04 OPa, while the Cr target, the Si target and the substrate were fed respectively with 30 W, 600 W (RF) and 8 W (RF). The biasing power is preferably between 0.5 and 20% of the power applied to the Si target. The subsequent bonding step was conducted not in a nitrogen atmosphere but in the atmosphere. Each of the spacers 10 was prepared by forming a Cr/Si nitride film 10*c* to a thickness of about 200 nm to show a specific resistance of $2.6\times10^3$ Ωm, a temperature coefficient of resistance of −0.6% and a composition ratio of Cr/Si=13.6 at. %.

Then, an image-forming apparatus comprising the spacers was prepared and operated for evaluation as in Example 1.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. Specifically, the resistance of the spacers was $6.2\times10^8$ Ω before the installation, $4.3\times10^8$ Ω after bonding the face plate and the rear plate, $8.7\times10^8$ Ω after the evacuation and also $9.0\times10^8$ Ω after the device electrode energization processes.

Then, the resistance was observed in minute areas of the spacers including those located close to the rear plate and those close to the face plate but no significant difference was found in the resistance after the entire assembling process to prove that the film had a uniform resistance distribution. When the image-forming apparatus comprising the spacers was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all.

After taking out the spacers, the surface was observed through an XPS (X-ray photoelectron spectrometer) to find that Cr was in the form of oxide on the surface but Si existed in the form of a mixture of nitride and oxide and that the Si nitride ratio (the concentration of nitrogen atoms of the silicon nitride/the concentration of silicon atoms) was between 66 and 71%. This indicates that the bonding step can be conducted in the atmosphere without reducing the silicon nitride ratio if the substrate is fed with RF biasing power in the preceding sputtering step for forming a Cr/Si nitride film on the spacer.

EXAMPLE 10

This example differed from Example 6 in that the Cr/Si nitride film 10*c* on the substrate of Example 6 was replaced by a Ta/Si compound film. Otherwise, the film forming process of Example 1 was followed. The specific sputtering conditions were as follows. Argon and nitrogen partial pressures were 0.093 Pa and 0.040 Pa, while the Ta target and the Si target were fed respectively with 240 W and 600 W (RF). Each of the spacers 10 was prepared by forming a Ta/Si nitride film 10*c* to a thickness of about 240 nm to show a specific resistance of $5.9\times10^3$ Ωm, a temperature coefficient of resistance of −0.6% and a composition ratio of Ta/Si=56.2 at. %.

Then, an image-forming apparatus comprising the spacers was prepared and operated for evaluation as in Example 1.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. Specifically, the resistance of the spacers was $1.2\times10^9$ Ω before the installation, $8.4\times10^8$ Ω after bonding the face plate and the rear plate, $1.9\times10^9$ Ω after the evacuation and also $2.0\times10^9$ Ω after the device electrode energization processes.

Then, the resistance was observed in minute areas of the spacers including those located close to the rear plate and those close to the face plate but no significant difference was found in the resistance after the entire assembling process to prove that the film had a uniform resistance distribution. When the image-forming apparatus comprising the spacers was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all.

After taking out the spacers, the surface was observed through an XPS (X-ray photoelectron spectrometer) to find that Ta was in the form of oxide on the surface but Si existed in the form of a mixture of nitride and oxide and that the Si nitride ratio (the concentration of nitrogen atoms of the silicon nitride/the concentration of silicon atoms) was between 88 and 93%.

EXAMPLE 11

This example differed from Example 6 in that the Cr/Si nitride film 10*c* on the substrate of Example 6 was replaced by a Ti/Si compound film. Otherwise, the film forming process of Example 1 was followed. The specific sputtering conditions were as follows. Argon and nitrogen partial pressures were 0.093 Pa and 0.04 OPa, while the Ti target and the Si target were respectively fed with 70 or 160 W and 600 W (RF). Two different sets of spacers were prepared. In set (1), each of the spacers 10 was prepared by forming a Ti/Si nitride film 10*c* to a thickness of about 180 nm to show a specific resistance of $3.8\times10^5$ Ωm by feeding the Ti target with power of 160 W. In set (2), each of the spacers 10 was prepared by forming a Ti/Si nitride film 10*c* to a thickness of about 70 nm to show a specific resistance of $2.4\times10^7$ Ωm by feeding the Ti target with power of 70 W. The temperature coefficient of resistance was −0.6% and the composition ratio was Ti/Si=48.3 at. % for (1) and Ti/Si=21.9 at % for (2).

Then, an image-forming apparatus comprising the spacers was prepared for each set and operated for evaluation as in Example 1. Scan signals and modulation signals were applied from a signal generating means (not shown) to the electron-emitting devices 1 of the finished image-forming apparatus that have been prepared in a manner as described above in Example 1 by way of the external terminals Dx1–Dxm and Dy1–Dyn to cause them to emit electrons, while a high voltage was applied to the metal back 6 by way of the high voltage terminal Hv to accelerate the emitted electrons and cause them to collide with the fluorescent film 5 in order to make the fluorescent members excite and emit light to display images.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. Specifically, the resistance of the spacers was $1.0\times10^9$ Ω before the installation, $7.4\times10^8$ Ω after bonding the face plate and the rear plate, $1.4\times10^9$ Ω after the evacuation and $1.4\times10^9$ Ω after the device electrode energization processes for (1) and $1.6\times10^{11}$ Ω before the installation, $9.7\times10^{10}$ Ω after bonding the face plate and the rear plate, $2.9\times10^{11}$ Ω after the evacuation and $3.8\times10^{11}$ Ω after the device electrode energization processes for (2).

Then, the resistance was observed in minute areas of the spacers including those located close to the rear plate and those close to the face plate but no significant difference was found in the resistance after the entire assembling process to prove that the film had a uniform resistance distribution. When the image-forming apparatus comprising the spacers with the specific resistance of $3.8\times10^3$ Ωm was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all.

After taking out the spacers, the surface was observed through an XPS (X-ray photoelectron spectrometer) to find that Ti was in the form of oxide on the surface but Si existed in the form of a mixture of nitride and oxide and that the Si nitride ratio (the concentration of nitrogen atoms of the silicon nitride/the concentration of silicon atoms) was between 83 and 87%.

On the other hand, electron beams were diverted to some extent near the spacers to produce disturbed images in the image-forming apparatus comprising the spacers with the greater specific resistance ($2.4\times10^5$ Ωm).

Additionally, it was found that, when a transition metal/silicon nitride film is used as charge-reducing film, the film containing more silicon nitride on the surface can effectively suppress electric charges and that a surface nitridation ratio (the concentration of nitrogen atoms of the silicon nitride/the concentration of silicon atoms) greater than 65% can be achieved under appropriate film forming conditions (heated substrate, application of biasing power, etc.) if the subsequent bonding operation is conducted in the atmosphere.

EXAMPLE 12

In this example, each of the spacers was prepared by forming silicon nitride film to a thickness of 0.5 μm as an Na block layer 10*b* on an insulating substrate 10*a* (3.8 mm wide, 200 μm thick and 40 mm long) made of clean soda lime glass and forming a film of Cr/B nitride 10*c* by vacuum evaporation.

As in the case of Example 1, the Cr/B nitride film of this example was produced by sputtering Cr and BN targets simultaneously in an atmosphere of a mixture of argon and nitrogen by means of a sputtering system. The composition of the deposited film was controlled by regulating the powers fed to the respective targets to achieve an optimal resistance. The specific sputtering conditions were as follows. Argon and nitrogen partial pressures were 0.093 Pa and 0.04 OPa, while the Cr target and the BN target were fed respectively with 20, 32 or 50 W and 600 W (RF). The substrates were held to room temperature and grounded.

The following three different Cr/B nitride films were prepared in this example for three sets of spacers; (1) film thickness: 55 nm, specific resistance: 13 Ωm, Cr target: 50 W, Cr/B composition ratio 103 at. % (atom %), (2) film thickness: 240 nm, specific resistance: $3.0\times10^3$ Ωm, Cr target: 32 W, Cr/B composition ratio 37 at. % and (3) film thickness: 115 nm, specific resistance: $8.4\times10^6$ Ωm, Cr target: 20 W, Cr/B composition ratio 11 at. %.

Then, image-forming apparatus comprising the respective set of spacers were prepared. In order to establish a reliable electric connection between each of the spacers 10, the related X-directional wire and the metal back, an Al electrode 11 was formed on the junctioning area of the spacer 10. The electrode 11 also covered the four lateral sides of the spacer 10 that was exposed to the inside of the envelope 8 by 50 μm from the X-directional wire toward the face plate and by 300 μm from the metal back toward the rear plate. The spacers 10 coated with a Cr/B nitride film 10*c* were then secured to the respective X-directional wires 9 at regular intervals.

Thereafter, the face plate 7 was arranged 3.8 mm above the electron sources with the support frame 3 interposed therebetween and the rear plate 2, the face plate 7, the support frame 3 and the spacers 10 were firmly bonded at the junctions thereof.

More specifically, frit glass was applied to junctions of the electron sources 1 and the rear plate 2, of the rear plate 2 and the support frame 3 and also of the face plate 7 and the support frame 3 and they were airtightly bonded to each other by baking them at 430° C. for more than 10 minutes in a nitrogen atmosphere in order to prevent the boron/transition metal nitride film on the surface of the spacers from being oxidized.

Electroconductive frit glass containing Au-coated silica pellets was applied to the black stripes 5*b* (width: 300 μm) on the face plate 7 in order to establish an electric connection between the charge-reducing film on the spacers and the face plate 7. The metal back was partly removed in areas where it abuts the spacers.

Scan signals and modulation signals were applied from a signal generating means (not shown) to the electron-emitting devices 1 of the finished image-forming apparatus that have been prepared in a manner as described above in Example 1 by way of the external terminals Dx1–Dxm and Dy1–Dyn to cause them to emit electrons, while a high voltage was applied to the metal back 6 by way of the high voltage terminal Hv to accelerate the emitted electrons and cause them to collide with the fluorescent film 5 in order to make the fluorescent members excite and emit light to display images. The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. For example, the resistance of the spacers with the specific resistance of $3.0\times10^3$ Ωm was $5.9\times10^8$ Ω before the installation, $2.1\times10^8$ Ω after bonding the face plate and the rear plate, $8.4\times10^8$ Ω after the evacuation and $8.6\times10^8$ Ω after the device electrode energization processes. This fact indicates that the Cr/B nitride film was very stable and operated suitably as charge-reducing film.

When the image-forming apparatus comprising the spacers with the specific resistance of $3.0\times10^3$ Ωm was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all. The temperature coefficient of resistance of this material was −0.5% and no thermal runaway was observed at Va=5 kV.

After taking out the spacers, the surface was observed through an XPS (X-ray photoelectron spectrometer) to find that Cr was in the form of oxide on the surface but B existed in the form of a mixture of nitride and oxide and that the B nitride ratio (the concentration of nitrogen atoms of the boron nitride/the concentration of boron atoms) was between 71 and 75%.

The spacers with the specific resistance of 13 Ωm showed a thermal runaway at Va=2 kV and hence it was impossible to apply 2 kV because of the disrupted charge-reducing film. While the spacers with the specific resistance as high as $8.4\times10^6$ Ωm did not show any thermal runaway, their charge-reducing effect was weak and the image-forming apparatus comprising them showed distorted images as electron beams were drawn to the spacers.

EXAMPLE 13

This example differed from Example 12 in that the bonding step was conducted not in a nitrogen atmosphere but in the atmosphere. (Otherwise, the manufacturing conditions for the spacers with the thickness of 240 nm and the specific resistance of $3.0\times10^3$ Ωm in Example 12 were used.) Then, each of the spacers 10 was prepared by forming a Cr/B nitride film 10*c* to have a thickness of 190 nm and show a specific resistance of $3.4\times10^3$ Ωm, a temperature coefficient of resistance of −0.7% and a composition ratio of Cr/B=37 at. %.

Then, an image-forming apparatus comprising the spacers was prepared and operated for evaluation as in Example 1.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. However, electron beams were diverted by 100 to 200 $\mu$m near the spacers to show slightly disturbed images.

The resistance of the spacers was $8.5\times10^8$ Ω before the installation, $4.3\times10^8$ Ω after bonding the face plate and the rear plate, $9.7\times10^8$ Ω after the evacuation and $9.6\times10^8$ Ω after the device electrode energization processes.

After taking out the spacers, the surface was observed through an XPS (X-ray photoelectron spectrometer) to find that the B nitride ratio (the concentration of nitrogen atoms of the boron nitride/the concentration of boron atoms) was as low as between 52 and 56% to prove that the oxide existed to an enhanced proportion. This fact suggests that spacers are apt to be electrically charged to divert electrons from due courses when the content of Cr/B nitride of the spacers is reduced to raise the oxide content.

However, there may be a range where the B nitride ratio (the concentration of nitrogen atoms of the boron nitride/the concentration of boron atoms) is relatively low but does not affect electron beams.

EXAMPLE 14

This example differed from Example 12 in that the substrate was heated to 250° C. during the operation of forming a Cr/B nitride film on each of the spacers by sputtering the Cr and BN targets simultaneously in an atmosphere of a mixture of argon and nitrogen and the subsequent bonding step was conducted not in a nitrogen atmosphere but in the atmosphere. (Otherwise, the manufacturing conditions for the spacers with the thickness of 240 nm and the specific resistance of $3.0\times10^3$ Ωm in Example 12 were used.) The substrate is preferably heated to temperature between 100° C. and 450° C. Each of the spacers 10 was prepared by forming a Cr/B nitride film 10*c* to a thickness of about 220 nm to show a specific resistance of $2.7\times10^3$ Ωm, a temperature coefficient of resistance of −0.5% and a composition ratio of Cr/B=35 at. %.

Then, an image-forming apparatus comprising the spacers was prepared and operated for evaluation as in Example 1.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. Specifically, the resistance of the spacers was $5.8\times10^8$ Ω before the installation, $2.1\times10^8$ Ω after bonding the face plate and the rear plate, $8.4\times10^8$ Ω after the evacuation and $8.8\times10^8$ Ω after the device electrode energization processes.

Then, the resistance was observed in minute areas of the spacers including those located close to the rear plate and those close to the face plate but no significant difference was found in the resistance after the entire assembling process to prove that the film had a uniform resistance distribution. When the image-forming apparatus comprising the spacers was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all.

After taking out the spacers, the surface was observed through an XPS (X-ray photoelectron spectrometer) to find that Cr was in the form of oxide on the surface but B existed in the form of a mixture of nitride and oxide and that the B nitride ratio (the concentration of nitrogen atoms of the boron nitride/the concentration of boron atoms) was 73%. This indicates that the bonding step can be conducted in the atmosphere without reducing the boron nitride ratio if the substrate is heated to 250° C. in the preceding sputtering step for forming a Cr/B nitride film on the spacer. A bonding step conducted in the atmosphere can significantly reduce the manufacturing cost.

EXAMPLE 15

This example differed from Example 14 in that RF biasing power was applied to the substrate by tens of several watts during the operation of forming a Cr/B nitride film on each of the spacers by sputtering the Cr and BN targets simultaneously in an atmosphere of a mixture of argon and nitrogen. The specific sputtering conditions were as follows. Argon and nitrogen partial pressures were 0.093 Pa and 0.040 Pa, while the Cr target, the BN target and the substrate were fed respectively with 32 W, 600 W (RF) and 60 W (RF). The biasing power is preferably between 0.5 and 20% of the power applied to the BN target. The subsequent bonding step was also conducted in the atmosphere. Each of the spacers 10 was prepared by forming a Cr/B nitride film 10*c* to a thickness of about 200 nm to show a specific resistance of $2.2\times10^3$ Ωm, a temperature coefficient of resistance of −0.4% and a composition ratio of Cr/B=34 at. %.

Then, an image-forming apparatus comprising the spacers was prepared and operated for evaluation as in Example 1.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. Specifically, the resistance of the spacers was $5.2\times10^8$ Ω before the installation, $1.9\times10^8$ Ω after bonding the face plate and the rear plate, $7.9\times10^8$ Ω after the evacuation and $8.3\times10^8$ Ω after the device electrode energization processes.

Then, the resistance was observed in minute areas of the spacers including those located close to the rear plate and those close to the face plate but no significant difference was found in the resistance after the entire assembling process to prove that the film had a uniform resistance distribution. When the image-forming apparatus comprising the spacers was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all.

After taking out the spacers, the surface was observed through an XPS (X-ray photoelectron spectrometer) to find that Cr was in the form of oxide on the surface but B existed in the form of a mixture of nitride and oxide and that the B nitride ratio (the concentration of nitrogen atoms of the boron nitride/the concentration of boron atoms) was 83%. This indicates that the bonding step can be conducted in the atmosphere without reducing the boron nitride ratio if the substrate is fed with RF biasing power in the preceding sputtering step for forming a Cr/B nitride film on the spacer.

EXAMPLE 16

This example differed from Example 12 in that the Cr/B nitride film 10*c* on the substrate of Example 12 was replaced by a Ta/B compound film. Otherwise, the film forming process of Example 12 was followed. The specific sputtering conditions were as follows. Argon and nitrogen partial pressures were 0.093 Pa and 0.040 Pa, while the Ta target and the BN target were fed respectively with 180 W and 600 W (RF). Each of the spacers 10 was prepared by forming a Ta/B nitride film 10*c* to a thickness of about 195 nm to show a specific resistance of $5.7\times10^3$ Ωm, a temperature coefficient of resistance of −0.3% and a composition ratio of Ta/B=67 at. %.

Then, an image-forming apparatus comprising the spacers was prepared and operated for evaluation as in Example 1.

The voltage Va applied to the high voltage terminal Hv was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. Specifically, the resistance of the spacers was $1.4\times10^9$ Ω before the installation, $6.7\times10^8$ Ω after bonding the face plate and the rear plate, $2.1\times10^9$ Ω after the evacuation and $2.3\times10^9$ Ω after the device electrode energization processes.

Then, the resistance was observed in minute areas of the spacers including those located close to the rear plate and those close to the face plate but no significant difference was found in the resistance after the entire assembling process to prove that the film had a uniform resistance distribution. When the image-forming apparatus comprising the spacers was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all.

After taking out the spacers, the surface was observed through an XPS (X-ray photoelectron spectrometer) to find that Ta was in the form of oxide on the surface but B existed in the form of a mixture of nitride and oxide and that the B nitride ratio (the concentration of nitrogen atoms of the boron nitride/the concentration of boron atoms) was between 78 and 83%.

EXAMPLE 17

This example differed from Example 12 in that the Cr/B nitride film 10*c* on the substrate of Example 12 was replaced by a Ti/B nitride film. Otherwise, the film forming process of Example 12 was followed. The specific sputtering conditions were as follows. Argon and nitrogen partial pressures were 0.093 Pa and 0.040 Pa, while the Ti target and the BN target were fed respectively with 50 or 120 W and 600 W (RF). Two different sets of spacers were prepared. In set (1), each of the spacers 10 was prepared by forming a Ti/B nitride film 10*c* to a thickness of about 110 nm to show a specific resistance of $2.6\times10^3$ Ωm. In set (2), each of the spacers 10 was prepared by forming a Ti/B nitride film 10*c* to a thickness of about 90 nm to show a specific resistance of $4.6\times10^5$ Ωm. The temperature coefficient of resistance was −0.4% and the composition ratio was Ti/B=59 at. % for (1) and Ti/B=17 at % for (2).

Then, an image-forming apparatus comprising the spacers was prepared for each set and operated for evaluation as in Example 1. Scan signals and modulation signals were applied from a signal generating means (not shown) to the electron-emitting devices 1 of the finished image-forming apparatus that have been prepared in a manner as described above in Example 1 by way of the external terminals Dx1–Dxm and Dy1–Dyn to cause them to emit electrons, while a high voltage was applied to the metal back 6 by way of the high voltage terminal Hv to accelerate the emitted electrons and cause them to collide with the fluorescent film 5 in order to make the fluorescent members excite and emit light to display images.

The voltage Va applied to the high voltage terminal was between 1 kV and 5 kV and the voltage Vf applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes. Specifically, the resistance of the spacers was $1.1\times10^9$ Ω before the installation, $6.4\times10^8$ Ω after bonding the face plate and the rear plate, $2.5\times10^9$ Ω after the evacuation and $2.7\times10^9$ Ω after the device electrode energization processes for (1) and $2.4\times10^{11}$ Ω before the installation, $1.1\times10^{11}$ Ω after bonding the face plate and the rear plate, $2.9\times10^{11}$ Ω after the evacuation and $3.1\times10^{11}$ Ω after the device electrode energization processes for (2).

Then, the resistance was observed in minute areas of the spacers including those located close to the rear plate and those close to the face plate but no significant difference was found in the resistance after the entire assembling process to prove that the film had a uniform resistance distribution. When the image-forming apparatus comprising the spacers with the specific resistance of $2.6\times10^3$ Ωm was driven to operate at this stage, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances in the electric field that could divert electrons from their due courses and the spacers were not electrically charged at all.

After taking out the spacers, the surface was observed through an XPS (X-ray photoelectron spectrometer) to find that Ti was in the form of oxide on the surface but B existed in the form of a mixture of nitride and oxide and that the B nitride ratio (the concentration of nitrogen atoms of the boron nitride/the concentration of boron atoms) was between 73 and 79%.

On the other hand, electron beams were diverted to some extent near the spacers to produce disturbed images in the image-forming apparatus comprising the spacers with the greater specific resistance ($4.6\times10^5$ Ωm).

EXAMPLE 18

In this example, each of the spacers was prepared by forming silicon nitride film to a thickness of 0.5 μm as an Na block layer 10*b* on an insulating substrate 10*a* (3.8 mm wide, 200 μm thick and 20 mm long) made of clean soda lime glass and forming a film of Ti/Al nitride 10*c* by vacuum evaporation.

The Ti/Al nitride film of this example was produced by sputtering Ti and Al targets simultaneously in an atmosphere of a mixture of argon and nitrogen by means of the sputtering system of Example 1.

Argon and nitrogen were fed into the film forming chamber 41 to show respective partial pressures of 0.5 Pa and 0.2 Pa and a high frequency voltage was applied to each of the targets and the spacer substrate to give rise to an electric discharge for sputtering. The composition of the deposited film was modified by regulating the powers fed to the respective targets to achieve an optimal resistance. The following two different Ti/Al nitride films were prepared by in this example for two sets of spacers.

(1) The Al target and the Ti target respectively with 500 W and 120 W for 15 minutes. The film thickness was 150 nm and the specific resistance was $5.2\times10^3$ Ωm.

(2) The Al target and the Ti target respectively with 500 W and 80 W for 20 minutes. The film thickness was 210 nm and the specific resistance was $1.4\times10^5$ Ωm.

Then, image-forming apparatus comprising the respective set of spacers were prepared. In order to establish a reliable electric connection between each of the spacers 10, the related X-directional wire and the metal back, an Al electrode 11 was formed on the Functioning area of the spacer 10. The electrode 11 also covered the four lateral sides of the spacer 10 that was exposed to the inside of the envelope 8 by 50 μm from the X-directional wire toward the face plate and by 300 μm from the metal back toward the rear plate.

The spacers 10 coated with a Ti/Al nitride film 10*c* were then heated at 430° C. for an hour in the atmosphere to transform the surface of the Ti/Al nitride film into a Ti/Al alloy oxide film 10*d*. As a result of an analysis using secondary ion mass spectrometry, it was found that the oxide film was about 25 nm thick.

Thereafter, the face plate 7 was arranged 3.8 mm above the electron sources with the support frame (lateral walls) 3 interposed therebetween and the rear plate 2, the face plate 7, the support frame 3 and the spacers 10 were firmly bonded at the junctions thereof. Electroconductive frit glass containing Au-coated silica pellets was applied to the black stripes 5*b* (width: 300 μm) on the face plate 7 in order to establish an electric connection between the charge-reducing film on the spacers and the face plate 7. The metal back was partly removed in areas where it abuts the spacers.

More specifically, frit glass was applied to the rear plate 2 and the support frame 3 at the junctions thereof and also to the face plate 7 and the support frame 3 at the junctions thereof and they were airtightly bonded to each other by baking them at 420° C. for more than 10 minutes in the atmosphere.

The inside of the prepared envelope 8 was then evacuated through an exhaust pipe by means of a vacuum pump to establish satisfactory low pressure therein and subsequently a voltage was applied to the device electrodes 14, 15 of the electron-emitting devices 1 by way of the external terminals Dx1–Dxm and Dy1–Dyn of the container in order to produce an electron-emitting region 17 in each of the electron-emitting devices 1 in an energization forming process. FIG. 7 shows the waveform of the voltage used in the energization forming process.

Then, acetone was introduced into the vacuum container by way of the exhaust pipe until the internal pressure got to 0.133 Pa. Thereafter, an energization activation process was conducted to deposit carbon or a carbon compound by periodically applying a voltage pulse to the device electrodes by way of the external terminals Dx1–Dxm and Dy1–Dyn of the container. FIG. 8A shows the waveform of the voltage used in the energization activation process.

Subsequently, the entire container was heated to 200° C. for 10 hours to completely evacuate the inside to a pressure level of about $10^{-4}$ Pa and then the exhaust pipe was closed by heating and melting it by means of a gas burner to airtightly seal the envelope 8.

Finally, the container was subjected to a gettering process to maintain the vacuum in the inside after the sealing.

Scan signals and modulation signals were applied from a signal generating means (not shown) to the electron-emitting devices 1 of the finished image-forming apparatus by way of the external terminals Dx1–Dxm and Dy1–Dyn to cause them to emit electrons, while a high voltage was applied to the metal back 6 by way of the high voltage terminal Hv to accelerate the emitted electrons and cause them to collide with the fluorescent film 5 in order to make the fluorescent members excite and emit light to display images. The voltage Va applied to the high voltage terminal Hv was between 1 kV and 5 kV and the voltage Vf applied between the device electrodes 14, 15 of each of the electron-emitting devices 1 was 14V.

Table 2 shows the resistance of the spacers 10 and its performance obtained in the listed examples.

Figure 17:
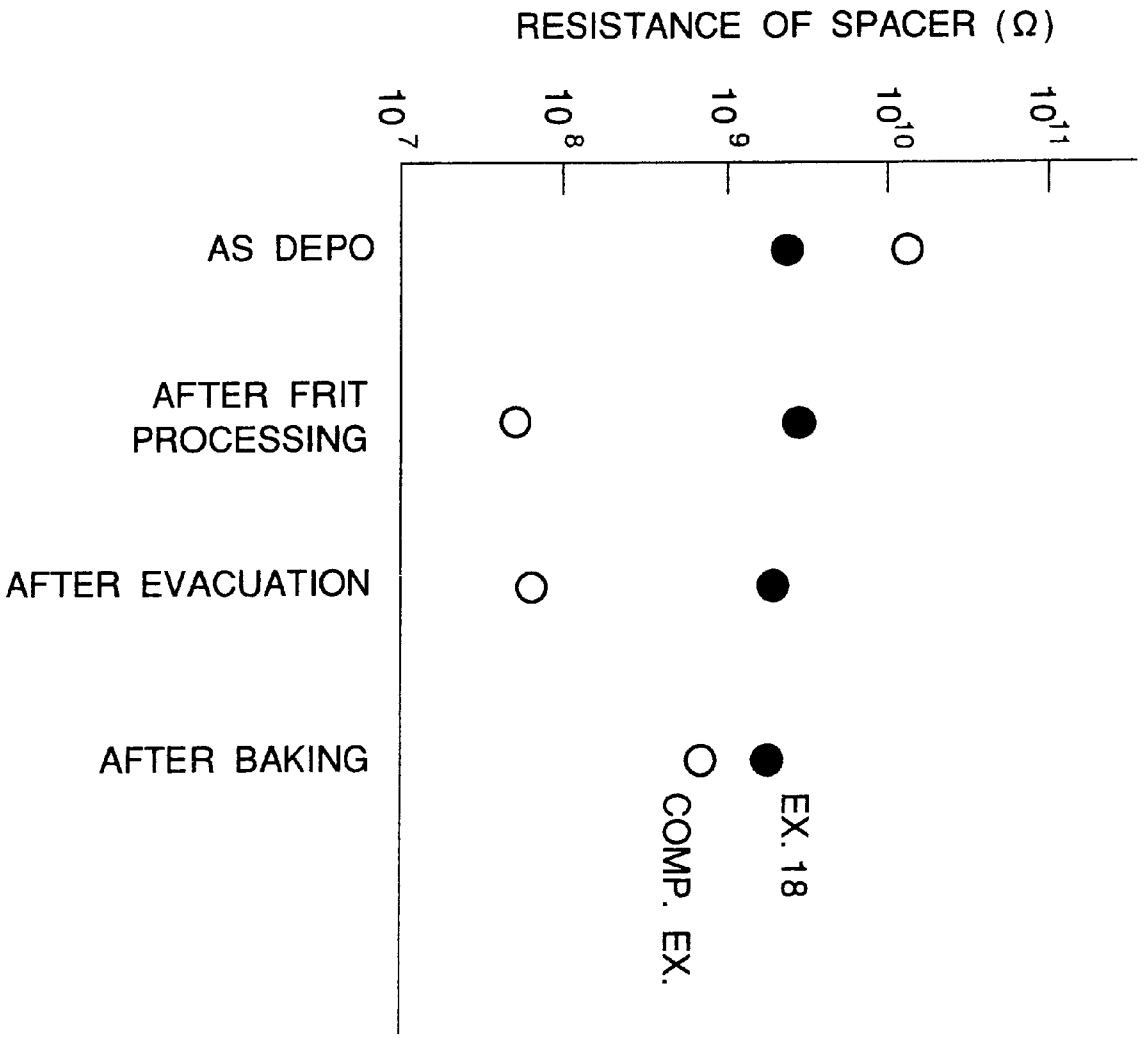
FIG. 17 is a graph showing the change in the resistance of a spacer observed during the process of manufacturing a display according to the invention in some examples as will be described hereinafter.

The resistance was observed before installing the spacers, after bonding them to the face plate, after bonding them to the rear plate and after the evacuation and each of the energization processes to prove that practically no fluctuations were observed in the resistance throughout the entire processes. This fact indicates that the Ti/Al nitride film was very stable and operated excellently as a charge-reducing film. FIG. 17 shows how the resistance varied during the manufacturing steps (black spots).

When the image-forming apparatus provided with the spacers having a specific resistance of the order of $10^3$ Ωm was driven to operate, rows of light emitting spots including those due to electrons emitted from the electron-emitting devices 1 located close to the spacers were formed and spread two-dimensionally at regular intervals so that very clear and reproducible color images were displayed. This fact indicates that the spacers 10 did not give rise to any disturbances that could divert electrons from their due courses and the spacers were not electrically charged at all. The temperature coefficient of resistance of the used material was −0.4% and no thermal runaway was observed at Va=5 kV.

While the spacers with a specific resistance of the order of $10^5$ Ωm did not show any thermal runaway, their charge-reducing effect was weak and disturbed images were displayed as some electron beams were drawn toward the spacers.

EXAMPLE 19

After forming an underlayer of Ti/Al nitride film to a thickness of 60 nm to show a specific resistance of $7.6\times10^3$ Ωm, a Ni oxide film was formed thereon as surface layer to a thickness of 10 nm to produce a complete charge-reducing film. The Ti/Al nitride film was formed in a sputtering system as shown in FIG. 14 for 6 minutes under the conditions same as those used in Example 18 except that the Ti target was fed with 110 W. The Ni oxide film was formed by sputtering, feeding the Ni oxide target with 200 W in an atmosphere of argon with pressure of 1 Pa.

An image-forming apparatus comprising the spacers and electron-emitting devices was prepared as in Example 18.

No thermal runaway nor disturbed images were observed in the image-forming apparatus at Va=5 kV. The resistance changed only within 20% during the process of assembling the image-forming apparatus.

EXAMPLE 20

This example differed from Example 18 in that the Ti/Al nitride film of the spacers of Example 18 was replaced by a Cr/Al nitride film in this example. The Cr/Al nitride film of this example was produced by sputtering Cr and Al targets simultaneously in an atmosphere of a mixture of argon and nitrogen by means of a sputtering system. FIG. 14 schematically shows the sputtering system used for this example. Argon and nitrogen were fed into the film forming chamber 41 to show respective partial pressures of 0.5 Pa and 0.2 Pa and a high frequency voltage was applied to each of the targets and the spacer substrate to give rise to an electric discharge for sputtering. The composition of the deposited film was modified by regulating the powers fed to the respective targets to achieve an optimal resistance. The following two different Ti/Al nitride films were prepared in this example for two sets of spacers. The film showed a temperature coefficient of resistance of −0.3%.

(1) The Al target and the Cr target respectively with 500 W and 12 W for 12 minutes. The film thickness was about 130 nm and the specific resistance was $2.2\times10^3$ Ωm.

(2) The Al target and the Cr target respectively with 500 W and 10 W for 20 minutes. The film thickness was 200 nm and the specific resistance was $1.5\times10^4$ Ωm.

Then, image-forming apparatus comprising respective sets of spacers were prepared and operated for evaluation as in Example 1. Scan signals and modulation signals were applied from a signal generating means (not shown) to the electron-emitting devices 1 of the finished image-forming apparatus by way of the external terminals Dx1–Dxm and Dy1–Dyn to cause them to emit electrons, while a high voltage was applied to the metal back 6 by way of the high voltage terminal Hv to accelerate the emitted electrons and cause them to collide with the fluorescent film 5 in order to make the fluorescent members excite and emit light to display images.

The voltage Va applied to the high voltage terminal was between 1 kV and 5 kV and the voltage Vf applied between the device electrodes 14, 15 of each of the electron-emitting devices 1 was 14V.

The resistance of the spacers was observed before installing the spacers (as depo), after bonding them to the face plate, after bonding them to the rear plate and after the evacuation and each of the energization processes to prove that practically no fluctuations were observed in the resistance throughout the entire processes.

As a result of an SIMS analysis, it was found that the Cr—Al nitride films of the two sets carried thereon a Cr—Al alloy oxide film layer 10*d* to respective thicknesses of 23 and 19 nm.

When the image-forming apparatus comprising the respective sets of spacers were driven to operate at this stage, rows of light emitting spots including those due to electrons emitted from the electron-emitting devices 1 located close to the spacers were formed and spread two-dimensionally so that very clear and reproducible color images were displayed. This fact indicates that the spacers 10 did not give rise to any disturbances in the electric field that could divert electrons from their due courses and the spacers were not electrically charged at all.

EXAMPLE 21

In this example, after forming a Cr/Al nitride film to a thickness of 130nm on a glass substrate coated with a silicon nitride film under the conditions used for the film with the specific resistance of $2.2\times10^3$ Ωm in Example 20, the Cr—Al nitride film was further grown to have a total thickness of 160 nm, gradually increasing the power being fed to the Cr target for 1 minute. The power was so controlled that the upper most lay contains with an Al/Cr alloy ratio of 1.

The prepared spacers were then heat treated at 450° C. for an hour in the atmosphere. As a result of the heat treatment, a surface layer of Cr—Al alloy oxide was formed to a thickness of 35 nm. The spacers were then used to prepare an image-forming apparatus as in Example 1.

Figure 18:
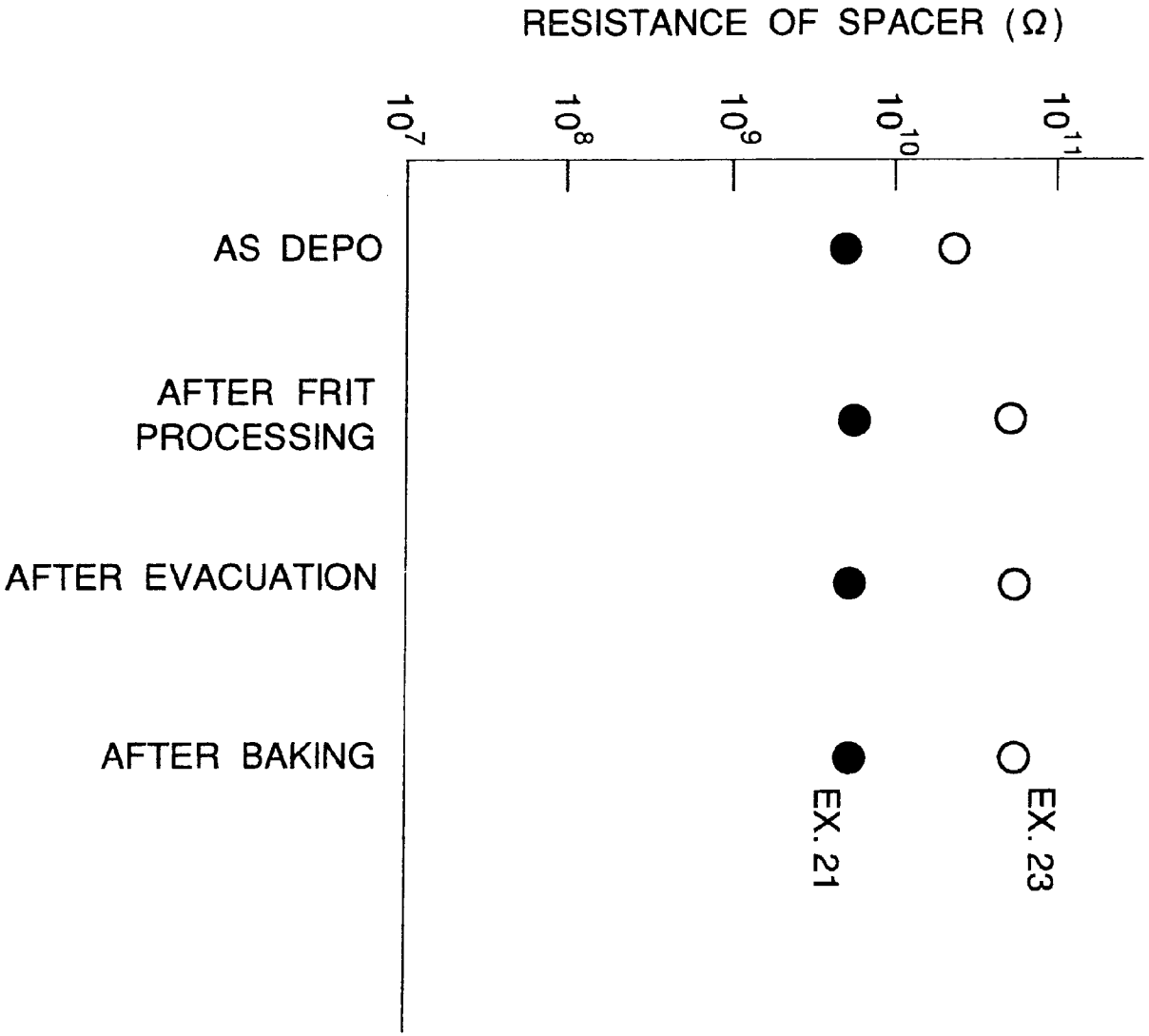
FIG. 18 is a graph showing the change in the resistance of a spacer observed during the process of manufacturing a display according to the invention in some other examples as will be described hereinafter.

The image-forming apparatus displayed fine images without any disturbances at Va=5 kV. FIG. 18 shows how the resistance varied during the manufacturing steps (black spots). No extreme changes were observed in the resistance.

EXAMPLE 22

Substrates similar to those of Example 20 were used and a Cr—Al nitride film was formed as an underlayer to a thickness of 200 nm to show a specific resistance of $6.5\times10^3$ Ωm in the sputtering system. More specifically, the sputtering system of FIG. 14 was used under the described conditions to produce the Cr/Al nitride film except that the Cr target was fed with 11 W for 20 minutes. Thereafter, a Cr oxide film as formed thereon by evaporation to a thickness of 7 nm. An electron beam evaporation technique was used to form the Cr oxide film, using Cr oxide as vapor source. The Cr oxide film grew at a rate of 1.2 nm per minute.

The image-forming apparatus prepared by using the spacers operated satisfactorily to show excellent images at Va=5 kV.

EXAMPLE 23

This example differed from Example 18 in that the Ti/Al nitride film 10*c* of the spacers 10 of Example 18 was replaced by a Ta/Al nitride film in this example. The Ta/Al nitride film of this example was produced by sputtering Ta and Al targets simultaneously in an atmosphere of a mixture of argon and nitrogen by means of a sputtering system. FIG. 14 schematically shows the sputtering system used for this example. Argon and nitrogen were fed into the film forming chamber 41 to show respective partial pressures of 0.5 Pa and 0.2 Pa and a high frequency voltage was applied to each of the targets and the spacer substrate to give rise to an electric discharge for sputtering. The composition of the deposited film was modified by regulating the powers fed to the respective targets to achieve an optimal resistance. More specifically, the Ta/Al nitride film was produced by feeding the Al and Ta targets respectively with 500 W and 135 W for 14 minutes. The film thickness was about 160 nm and the specific resistance was $4.4\times10^4$ Ωm. The temperature coefficient of resistance was −0.04%. The film was then heat treated at 450° C. for an hour to form a 30 nm thick Ta—Al alloy oxide surface layer and a 130 nm thick Ta—Al nitride underlayer.

Then, an image-forming apparatus comprising the spacers was prepared and operated for evaluation as in Example 1.

The voltage Va applied to the high voltage terminal Hv was between 1 kV and 5 kV and the voltage applied between the device electrodes 14, 15 of each of the electron-emitting devices 1 was 14V.

The resistance of the spacers was observed before installing the spacers, after bonding them to the face plate, after bonding them to the rear plate and after the evacuation and each of the energization processes to prove that practically no fluctuations were observed in the resistance throughout the entire processes.

The image-forming apparatus did not show any thermal runaway at Va=5 kV. While electron beams equivalent to ⅕ of the inter-scanning line gap were observed near the spacers, the image-forming apparatus displayed fine images.

FIG. 18 shows how the resistance varied during the manufacturing steps (white spots). No extreme changes were observed in the resistance in this example.

EXAMPLE 24

The oxidization process of Example 23 was replaced by electron beam evaporation in this example to produce a 20 nm Cu oxide surface layer. As a result, a film having a 160 nm thick Ta—Al nitride underlayer and a 20 nm thick Cu oxide surface layer was produced. The Ta—Al nitride film showed a specific resistance of $2.9\times10^4$ Ω.

The image-forming apparatus prepared by using the spacers did not show any thermal runaway at Va=5 kV and displayed fine images without distortions.

COMPARATIVE EXAMPLE

For the purpose of comparison, a charge-reducing film was prepared by using the above described process and Cr oxide. The spacers fluctuated remarkably as shown in FIG. 17 (white spots). The Cr oxide layer was formed by electron beam evaporation in this example as in Example 22 to a thickness of 50 nm. The resistance of the Cr oxide film was almost uncontrollable as it fluctuated remarkably during and after the process of preparing the image-forming apparatus. More specifically, the resistance differed remarkably among the spacers within a same lot, some showing a resistance twice as large as others, and it differed by more than ten times between the spacers of different lots. Additionally, the Cr oxide film on a spacer showed a varying resistance that changed remarkably depending on the location on the spacer. The electric field was distorted near the spacers. Thus, while the resistance of the spacers was found within an acceptable range, the image-forming apparatus comprising them diverted electrons from their due courses to produce distorted images.

EXAMPLE 25

Figure 19:
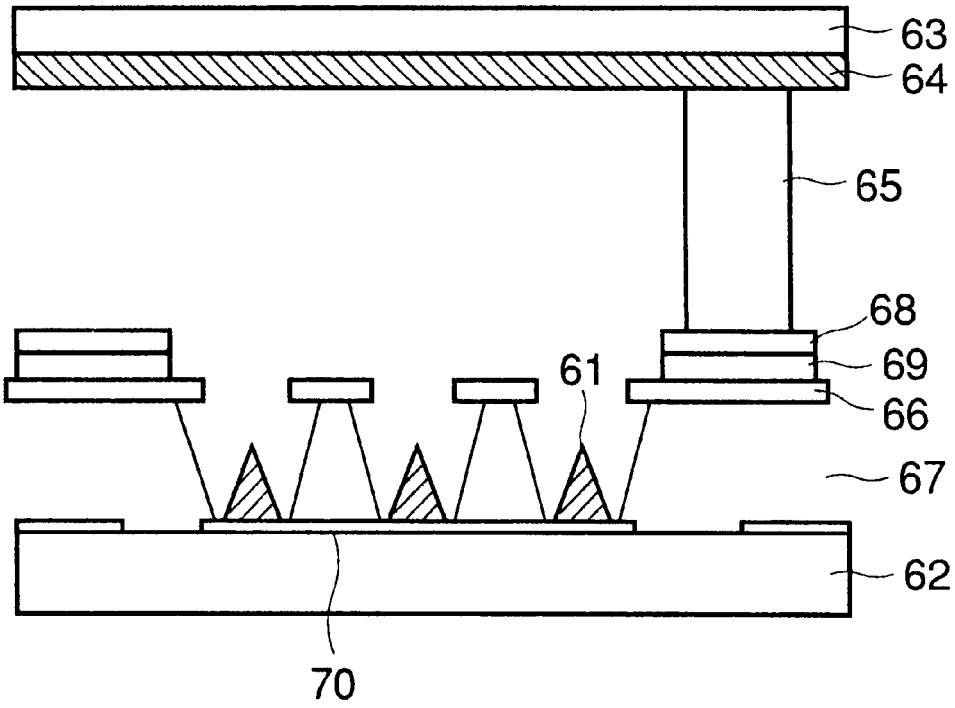
FIG. 19 is a schematic cross sectional view of an image-forming apparatus comprising electron-emitting devices according to the invention, showing a spacer and its vicinity.

FIG. 19 is a schematic cross sectional view of the image-forming apparatus prepared in the example, showing a portion of spacer near the electron source. In this example, field emission devices were used as electron-emitting devices.

Referring to FIG. 19, there are shown a rear plate 62, a face plate 63, a cathode 61, a gate electrode 66, a gate/cathode insulating layer 67, a focusing electrode 68, a fluorescent body 64, a focusing electrode/gate electrode insulating layer 69 and a cathode lead wire 70. Otherwise, there is also shown a spacer 65 comprising an insulating substrate and a tungsten/aluminum nitride film coat.

The electron-emitting device is so designed that it emits electrons from the front end of the cathode 61 when a large electric field is applied between the front end of the cathode 61 and the gate electrode 66. The gate electrode 66 is provided with electron holes that allow electrons coming from a plurality of cathodes to pass therethrough. After passing through the electron holes, the electrons are focused by the focusing electrode 68 and accelerated by the electric field of the anode arranged on the face plate 63 until they collide with the pixels on the oppositely disposed fluorescent body, which by turn emit light to display images. Note that a plurality of gate electrodes 68 and a plurality of cathode lead wires 70 are arranged to show a simple matrix as appropriate ones of the cathodes are selected by an input signal to emit electrons.

The cathodes, gate electrodes, focusing electrode and cathode lead wires of this example were prepared by a known method and Mo was used for the cathodes. Each of the spacer substrates was made of soda lime glass. It was 20 mm long, 1.2 mm wide and 0.2 mm thick. As in Example 5, a tungsten/aluminum nitride film was formed on the surface thereof to a thickness of 150 nm. The spacers 65 were then bonded to the focusing electrode 68 by means of electroconductive frit glass. An aluminum film was formed by evaporation on the areas of each spacer where it contacts with the focusing electrode and the fluorescent body in order to reduce the contact resistance.

The specific resistance of the tungsten/aluminum nitride film of this example was $2.2\times19^4$ Ωm and the spacers showed a resistance of $3.7\times10^9$ Ω.

Then, the rear plate 62 to which the spacers had been bonded and the face plate 63 on which the fluorescent body 64 had been formed were bonded together by means of frit glass in a nitrogen atmosphere with a support frame (not shown) interposed therebetween to produce an airtight container. The inside of the airtight container was then evacuated by way of an exhaust pipe and the container was baked at 250° C. for 10 hours. Thereafter, the inside was evacuated again to $10^{-5}$ Pa and the exhaust pipe was closed by melting it by means of a gas burner. Finally a gettering process was conducted by means of high frequency heating in order to maintain the enhanced degree of vacuum in the inside after the sealing operation.

The prepared image-forming apparatus was then driven to operate by applying signals to the cathodes 61 from signal generating means (not shown) by way of the external terminals of the container in order to cause the cathodes to emit electrons that are then accelerated by the transparent electrode arranged on the face plate and irradiate the fluorescent 64 to display images there.

The spacers stably showed a resistance of $4.2\times10^9$ Ω after the process of manufacturing the image-forming apparatus and no deviations of beams were observed near the spacers.

[Advantages of the Invention]

As described above, a charge-reducing film according to the invention is stable and highly reproducible because it is not accompanied by drawbacks including fluctuations in the resistance in an oxygen containing atmosphere and does not need to be made very thin to produce islands there in order to make it electrically highly resistive. A charge-reducing film according to the invention is also advantageous in that it has a high melting point and is very hard. The present invention exploits the fact that aluminum nitride, silicon nitride and boron nitride are electrically non-conductive while nitride of a transition metal is electrically highly conductive so that the composition of the charge-reducing film can be controlled to show a desired specific resistance. A charge-reducing film according to the invention finds applications in CRTs, discharge tubes and other electron tubes in addition to image-forming apparatus as illustrated above.

An image-forming apparatus according to the invention comprises insulating members arranged between the device substrate and the face plate and coated with a charge-reducing film according to the invention and containing nitride of aluminum, silicon or boron so that the resistance of the components of the apparatus does not significantly fluctuate throughout the manufacturing process. Therefore, the emitted electron beams practically do not show any disturbances in the potential and hence are made to correctly hit the respective targets without causing any loss in the brightness and the sharpness of the displayed images.

When the spacers are coated with an oxide surface layer arranged on the nitride compound film, they are further prevented from fluctuations throughout the process of manufacturing the image-forming apparatus. Additionally, the bonding step can be conducted in an oxidizing atmosphere to simplify the manufacturing process.

TABLE 1

| | Material | Transition metal content (at. %) | As depo resistance (Ω) | Resistance after panel preparation (Ω) | Film thickness (nm) | Specific resistance (Ω) | Nitridation ratio (%) | Displayed image |
|---|---|---|---|---|---|---|---|---|
| Ex. 1 | Cr—Al—N | 13 | 4.9E + 06 | 5.5E + 06 | 43 | 2.5 | 78 | |
| | Cr—Al—N | 7 | 1.0E + 09 | 1.1E + 09 | 200 | 2.4E + 03 | 77 | no beam deviations |
| | Cr—Al—N | 4 | 5.0E + 12 | 5.3E + 12 | 80 | 4.5E + 06 | 73 | remarkable b. dev.'s |
| Ex. 2 | Ta—Al—N | 39 | 4.4E + 09 | 3.9E + 09 | 150 | 6.2E + 03 | 75 | no beam deviations |
| Ex. 3 | Ti—Al—N | 28 | 4.8E + 08 | 8.7E + 08 | 60 | 5.5E + 03 | 72 | no beam deviations |
| | Ti—Al—N | 21 | 9.5E + 10 | 2.2E + 11 | 80 | 1.9E + 05 | 71 | slight b. dev.'s |
| Ex. 4 | Mo—Al—N | 2 | 4.0E + 11 | 4.2E + 11 | 200 | 8.8E + 05 | 80 | slight b. dev.'s |
| | Mo—Al—N | 4 | 2.5E + 10 | 2.5E + 10 | 200 | 5.3E + 04 | 79 | no beam deviations |
| | Mo—Al—N | 7 | 3.0E + 09 | 3.1E + 09 | 200 | 6.6E + 03 | 75 | no beam deviations |
| Ex. 5 | W—Al—N | 3 | 6.2E + 10 | 7.1E + 10 | 200 | 1.5E + 05 | 82 | no beam deviations |
| | W—Al—N | 5 | 2.0E + 10 | 2.1E + 10 | 200 | 4.4E + 04 | 83 | no beam deviations |
| | W—Al—N | 6 | 3.5E + 09 | 3.4E + 09 | 200 | 7.1E + 03 | 77 | no beam deviations |
| | W—Al—N | 10 | 5.3E + 07 | 7.8E + 07 | 200 | 1.6E + 02 | 70 | no beam deviations |

N.B
as depo resistance: resistance after the film formation
resistance after panel preparation: resistance after the preparation of the image-forming apparatus
nitridation ratio: nitrogen atoms/aluminum atoms of the aluminum nitride (as observed through XPS)
displayed image beam deviations: Some of the electrons emitted from the electron sources did not hit the fluorescent targets due to the charged spacers and the displayed images were recognizably distorted at the spacers.
slight beam deviations: Beam deviations were recognizable but not greater than 2/10 of the distance between two adjacent scanning lines.

TABLE 2

| | Underlying layer | | | | Surface layer | | | |
|---|---|---|---|---|---|---|---|---|
| | Material | Transition metal content | Thickness (nm) | Specific resistance (Ω) | Material | Thickness (nm) | resistance (Ω) | Displayed image |
| Ex. 18 | Ti—Al—N | 28 | 125 | $5.2 \times 10^3$ | Ti—Al—O | 25 | $3.8 \times 10^9$ | good |
| | Ti—Al—N | 21 | 185 | $1.4 \times 10^5$ | Ti—Al—O | 25 | $7.0 \times 10^{10}$ | slight beam deviations |
| Ex. 19 | Ti—Al—N | 27 | 60 | $7.6 \times 10^3$ | Ni oxide | 10 | $8.4 \times 10^9$ | good |
| Ex. 20 | Cr—Al—N | 7 | 107 | $2.2 \times 10^3$ | Cr—Al—O | 23 | $1.8 \times 10^9$ | good |
| | Cr—Al—N | 6 | 181 | $1.5 \times 10^4$ | Cr—Al—O | 19 | $8.3 \times 10^9$ | good |
| Ex. 21 | Cr—Al—N | 7 | 125 | $6.5 \times 10^3$ | Cr—Al—O | 35 | $4.8 \times 10^9$ | good |
| Ex. 22 | Cr—Al—N | 7 | 200 | $6.5 \times 10^3$ | Cr oxide | 7 | $2.8 \times 10^9$ | good |
| Ex. 23 | Ta—Al—N | 38 | 130 | $4.4 \times 10^4$ | Ta—Al—O | 30 | $3.2 \times 10^{10}$ | slight beam deviations |

TABLE 2-continued

| | Underlying layer | | | | Surface layer | | | |
|---|---|---|---|---|---|---|---|---|
| | Material | Transition metal content | Thickness (nm) | Specific resistance (Ω) | Material | Thickness (nm) | resistance (Ω) | Displayed image |
| Ex. 24 | Ta—Al—N | 38 | 160 | $2.9 \times 10^4$ | Cu oxide | 20 | $9.7 \times 10^9$ | good |
| Comp. Ex. | Cr oxide | — | 50 | $4.2 \times 10^2$ | none | | $8.0 \times 10^8$ | slight beam deviations |

What is claimed is:

1. A charge-reducing film comprising a first film containing a nitrogen, a transition metal and an element selected from aluminum, silicon and boron; and a second film of an oxide arranged on a surface of said first film.

2. A charge-reducing film according to claim 1, wherein said oxide is an oxide of the transition metal.

3. A charge-reducing film according to claim 1, wherein said oxide contains a transition metal and aluminum, silicon or boron.

4. A charge-reducing film according to claim 1, wherein said transition metal is at least one selected from chromium, titanium, tantalum, molybdenum and tungsten.

5. A charge-reducing film according to claim 1, wherein it has a film thickness between 10 nm and 1 μm.

6. A charge-reducing film according to claim 1, wherein it shows a negative thermal coefficient of resistance whose absolute value is not greater than 1%.

7. An image-forming apparatus comprising electron-emitting devices, an image-forming member and spacers arranged in an envelope, characterized in that each of said spacers comprises a substrate and a charge-reducing film formed thereon and according to any of claim 1.

8. A charge-reducing film according to claim 7, wherein said transition metal is at least one selected from chromium, titanium, tantalum, molybdenum and tungsten.

9. A charge-reducing film according to claim 7, wherein it has a film thickness between 10 nm and 1 μm.

10. A charge-reducing film according to claim 7, wherein it shows a negative thermal coefficient of resistance whose absolute value is not greater than 1%.

11. A charge-reducing film according to claim 7, wherein said oxide is an oxide of the transition metal.

12. A charge-reducing film according to claim 7, wherein said oxide contains a transition metal and aluminum, silicon or boron.

13. An image-forming apparatus comprising electron-emitting devices, an image-forming member and spacers arranged in an envelope, characterized in that each of said spacers comprises a substrate and a charge-reducing film formed thereon and according to any of claims 1 through 12.

14. An image-forming apparatus according to claim 13, wherein said charge-reducing film has a film thickness between 10 nm and 1 μm and a specific resistance of $10^{-7} \times Va^2$ to $10^5$ Ωm, where Va is the acceleration voltage applied to the emitted electrons.

15. An image-forming apparatus according to claim 13, wherein said substrate contains Na and an Na block layer is arranged between said substrate and said nitride compound film.

16. An image-forming apparatus according to claim 13, wherein said spacers are connected to an electrode member arranged within said envelope.

17. An image-forming apparatus according to claim 16, wherein said electrode member is an electrode for applying a drive voltage to said electron-emitting devices.

18. An image-forming apparatus according to claim 16, wherein said electrode member is an acceleration electrode arranged on said image-forming member to accelerate the emitted electrons.

19. An image-forming apparatus according to claim 13, wherein an voltage is applied to the opposite ends of each of said spacers to generate a potential difference therebetween.

20. An image-forming apparatus according to claim 13, wherein said spacers are connected to the electrode for applying a drive voltage to said electron-emitting devices and the acceleration electrode arranged on said image-forming member to accelerate the emitted electrons.

21. An image-forming apparatus according to claim 13, wherein said electron-emitting devices are cold-cathode type electron-emitting devices.

22. An image-forming apparatus according to claim 13, wherein said electron-emitting devices are surface-conduction electron-emitting devices.

23. A method of manufacturing an image-forming apparatus comprising electron-emitting devices, an image-forming member and spacers, comprising steps of preparing spacers by coating substrates with a charge-reducing film said charge-reducing film comprising a first film containing a nitrogen, a transition metal and an element selected from aluminum, silicon and boron; and a second film of an oxide arranged on a surface of said first film,and arranging the spacers, electron-emitting devices and an image-forming member in an envelope and thereafter hermetically sealing the envelope.

24. A method of manufacturing an image-forming apparatus according to claim 23, wherein said film coating step is a step of depositing said nitride compound on said substrates, while heating said substrates.

25. A method of manufacturing an image-forming apparatus according to claim 23, wherein said film coating step is a step of depositing said nitride compound on said substrates, while applying a voltage to said substrates.

26. A method of manufacturing an image-forming apparatus according to claim 23, wherein said sealing step is conducted in an oxidizing atmosphere.

27. A method according to claim 23, wherein said transition metal is at least one selected from chromium, titanium, tantalum, molybdenum and tungsten.

28. A method according to claim 23, wherein the charge-reducing film has a film thickness between 10 nm and 1 μm.

29. A method according to claim 23, wherein the charge-reducing film shows a negative thermal coefficient of resistance whose absolute value is not great than 1%.

30. A method according to claim 23, wherein the amount of said aluminum, said silicon or said boron being in the form of a nitride is not less than 60%.

31. A method according to claim 30, wherein said transition metal is at least one selected from chromium, titanium, molybdenum and tungsten.

32. A method according to claim 30, wherein the charge-reducing film has a film thickness between 10 nm and 1 $\mu$m.

33. A method according to claim 30, wherein the charge-reducing film shows a negative thermal coefficient of resistance whose absolute value is not greater than 1%.

34. A charge-reducing film comprising:

an oxide of a transition metal;

an oxide of an element selected from aluminum, silicon and boron; and a nitride of an element selected from aluminum, silicon and boron, wherein amount of the aluminum, silicon or boron being in the form of nitride is not less than 60%.

35. A charge-reducing film according to claim 34, wherein said transition metal is at least one selected from chromium, titanium, tantalum, molybdenum and tungsten.

36. A charge-reducing film according to claim 34, having a film thickness between 10 nm and 1$\mu$m.

37. A charge-reducing film according to claim 34, having a negative thermal coefficient of resistance whose absolute value is not greater than 1%.

38. An image-forming apparatus comprising electron-emitting devices, an image-forming member and spacers arranged in an envelope, wherein each of said spacers comprises a substrate and a charge-reducing film formed thereon and according to any of claims 34 or 35–37.

39. An image-forming apparatus according to claim 37, wherein said charge-reducing film has a film thickness between 10 nm and 1$\mu$m and a specific resisitance of $10^{-7}xVa^2$ to $10^5\Omega m$, where Va is the acceleration voltage applied to the emitted electrons.

40. An image-forming apparatus according to claim 37, wherein said substrate contains Na and an Na block layer is arranged between said substrate and said nitride compound film.

41. An image-forming apparatus according to claim 37, wherein said spacers are connected to an electrode member arranged within said envelope.

42. An image-forming apparatus according to claim 41, wherein said electrode member is an acceleration electrode arranged on said image-forming member to accelerate the emitted electrons.

43. An image-forming apparatus according to claim 41, wherein said electrode member is an electrode for applying a drive voltage to said electron-emitting devices.

44. An image-forming apparatus according to claim 38, wherein a voltage is applied to the opposite ends of each of said spacers to generate a potential difference therebetween.

45. An image-forming apparatus according to claim 38, wherein said spacers are connected to the electrode for applying a drive voltage to said electron-emitting devices and the acceleration electrode arranged on said image-forming member to accelerate the emitted electrons.

46. An image-forming apparatus according to claim 38, wherein said electron-emitting devices are cold-cathode type electron-emitting devices.

47. An image-forming apparatus according to claim 38, wherein said electron-emitting devices are surface-conduction electron-emitting devices.

48. An image-forming apparatus comprising electron-emitting devices, an image-forming member and spacers arranged in an envelope, wherein each of said spacers comprises a substrate and a charge-reducing film formed thereon said charge-reducisng film comprising:

an oxide of a transistion metal;

an oxide of an element selected from aluminum, silicon and boron; and a nitride of an element selected from aluminum, silicon and boron.

49. An image-forming apparatus according to claim 48, wherein said charge-reducing film has a film thickness between 10 nm and 1 $\mu$m and a specific resistance of $10^{-7}\times Va^2$ to $10^5\Omega m$, where Va is the acceleration voltage applied to the emitted electrons.

50. An image-forming apparatus according to claim 48, wherein said substrate contains Na and an Na block layer is arranged between said substrate and said nitride compound film.

51. An image-forming apparatus according to claim 48, wherein said spacers are connected to an electrode member arranged within said envelope.

52. An image-forming apparatus according to claim 51, wherein said electrode member is an electrode for applying a drive voltage to said electron-emitting devices.

53. An image-forming apparatus according to claim 51, wherein said electrode member is an acceleration electrode arranged on said image-forming member to accelerate the emitted electrons.

54. An image-forming apparatus according to claim 48, wherein a voltage is applied to the opposite ends of each of said spacers to generate a potential difference therebetween.

55. An image-forming apparatus according to claim 48, wherein said spacers are connected to the electrode for applying a drive voltage to said electron-emitting devices and the acceleration electrode arranged on said image-forming member to accelerate the emitted electrons.

56. An image-forming apparatus according to claim 48, wherein said electron-emitting devices are cold-cathode type electron-emitting devices.

57. An image-forming apparatus according to claim 48, wherein said electron-emitting devices are surface-conduction electron-emitting devices.

58. An image-forming apparatus according to claim 48, wherein said transition metal is at least one selected from chromium, titanium, tantalum, molybdenum and tungsten.

59. An image-forming apparatus according to claim 48, wherein the charge-reducing film has a film thickness between 10 nm and 1$\mu$m.

60. An image-forming apparatus according to claim 48, wherein the charge-reducing film shows a negative thermal coefficient of resistance whose absolute value is not greater than 1%.

* * * * *

UNITED STATES PATENT AND TRADEMARK OFFICE

CERTIFICATE OF CORRECTION

PATENT NO. : 6,342,754 B1 
DATED : January 29, 2002
INVENTOR(S) : Kazuo Kuroda et al.

It is certified that error appears in the above-identified patent and that said Letters Patent is hereby corrected as shown below:

Title page,
Item [56], References Cited, FOREIGN PATENT DOCUMENTS,
"407297265A" should read -- 7-297265 --.
Item [57], ABSTRACT,
Line 4, "furface." should read -- surface. --.

Column 1,
Line 67, "adhere" should read -- adhere to --.

Column 3,
Line 37, "or" should read -- of --.

Column 4,
Line 37, "example" should read -- example, --;
Line 64, "in order" should be deleted;
Line 66, "therein to" should read -- therein. --;
Line 67, "make-" should be deleted; and "resistance" should read -- the electric resistance --.

Column 10,
Line 26, "be" should be deleted.

Column 11,
Line 42, "Sa" should read -- 5a --.

Column 12,
Line 19, "(now" should read -- (not --.

Column 15,
Line 53, "is" should read -- can --.

Column 20,
Line 40, "300μpm)" should read -- 300μm- --; and
Line 67, "B." should read -- 8. --.

Column 21,
Line 38, "not" should read -- not be --.

UNITED STATES PATENT AND TRADEMARK OFFICE

CERTIFICATE OF CORRECTION

PATENT NO. : 6,342,754 B1
DATED : January 29, 2002
INVENTOR(S) : Kazuo Kuroda et al.

It is certified that error appears in the above-identified patent and that said Letters Patent is hereby corrected as shown below:

Column 24,
Line 25, "films were" should read -- film was --.

Column 25,
Line 6, "a nd" should read -- and --.

Column 28,
Line 11, "0.04 OPa" should read -- 0.040 Pa --.

Column 29,
Line 56, "0.04 OPa" should read -- 0.040 Pa --.

Column 31,
Line 16, "0.04 OPa" should read -- 0.040 Pa --.

Column 37,
Line 24, "by" should be deleted.

Column 40,
Line 16, "upper most lay contains with" should read -- uppermost layer contains --.

Column 41,
Line 43, "a same" should read -- the same --.

Column 42,
Line 60, "there" should be deleted; and
Line 66, "while" should read -- while a --.

Column 45,
Line 15, "comprising a" should read -- comprising: ¶ a --;
Line 16, "a nitrogen," should read -- nitrogen, --;
Lines 33-37, should read:

-- 7. A charge-reducing film comprising a first film containing nitrogen, a transition metal and an element selected from aluminum, silicon and boron, wherein the amount of said aluminum, silicon or boron being in the form of a nitride is not less than 60%; and a second film of an oxide arranged on a surface of said first film. --; and Line 55, "claims 1 through 12." should read -- 1 through 12 or 34. --.

UNITED STATES PATENT AND TRADEMARK OFFICE

CERTIFICATE OF CORRECTION

PATENT NO. : 6,342,754 B1 
DATED : January 29, 2002
INVENTOR(S) : Kazuo Kuroda et al.

It is certified that error appears in the above-identified patent and that said Letters Patent is hereby corrected as shown below:

Column 46,
Line 22, "an" should read -- a --; and
Line 64, "great" should read -- greater --.

Column 47,
Line 29, "claims 34 or 35-37." should read -- claims 34 to 37. --; and
Lines 30, 35 and 39, "claim 37," should read -- claim 38, --.

Column 48,
Line 8, "charge-reducisng" should read -- charge-reducing --.

Signed and Sealed this

Twenty-sixth Day of August, 2003

JAMES E. ROGAN
*Director of the United States Patent and Trademark Office*